US010066383B1

(12) United States Patent
Perasso

(10) Patent No.: US 10,066,383 B1
(45) Date of Patent: Sep. 4, 2018

(54) PRE-FABRICATED BUILDING CONSTRUCTION SYSTEM

(71) Applicant: Patrick Perasso, Ashville, NC (US)

(72) Inventor: Patrick Perasso, Ashville, NC (US)

( * ) Notice: Subject to any disclaimer, the term of this patent is extended or adjusted under 35 U.S.C. 154(b) by 0 days.

(21) Appl. No.: 15/490,256

(22) Filed: Apr. 18, 2017

(51) Int. Cl.

| | |
|---|---|
| ***E04B 1/16*** | (2006.01) |
| ***E04G 17/06*** | (2006.01) |
| ***E04B 1/18*** | (2006.01) |
| ***E04B 1/61*** | (2006.01) |
| ***E04B 2/86*** | (2006.01) |
| ***E04B 2/00*** | (2006.01) |
| ***E04G 11/06*** | (2006.01) |
| ***E04G 17/00*** | (2006.01) |

(52) U.S. Cl.
CPC ..... *E04B 1/167* (2013.01); *E04B 1/18* (2013.01); *E04B 1/617* (2013.01); *E04B 2/8635* (2013.01); *E04C 2/46* (2013.01); *E04G 11/06* (2013.01); *E04G 17/001* (2013.01); *E04G 17/06* (2013.01); *E04B 2002/867* (2013.01)

(58) Field of Classification Search
CPC ..... E04B 1/167; E04B 2/8635; E04B 1/617; E04B 1/18; E04B 2002/867; E04G 17/001; E04G 17/06; E04G 11/06; E04C 2/46
USPC ... 52/250, 293.1, 293.3, 294, 319, 378, 380, 52/415, 578, 79.14, 742.1, 742.13, 742.14
See application file for complete search history.

(56) References Cited

U.S. PATENT DOCUMENTS

| | | | | |
|---|---|---|---|---|
| 1,372,206 A * | 3/1921 | Stadelman | E04B 1/10 | 52/293.3 |
| 2,365,579 A * | 12/1944 | Mulligan | E04B 1/10 | 52/478 |
| 2,396,829 A * | 3/1946 | Carpenter | E04B 1/34315 | 52/126.7 |
| 2,401,589 A * | 6/1946 | Smith | E04B 1/26 | 123/41.63 |
| 2,717,664 A * | 9/1955 | Grafman | E04C 2/292 | 52/396.04 |
| 2,851,873 A * | 9/1958 | Wheeler-Nicholson | E04B 2/68 | 52/262 |
| 3,440,785 A * | 4/1969 | Denny | E04B 2/60 | 52/241 |

(Continued)

FOREIGN PATENT DOCUMENTS

| | | |
|---|---|---|
| WO | WO2005089177 | 9/2005 |
| WO | WO2012103133 | 8/2012 |
| WO | WO2012123118 | 9/2012 |

*Primary Examiner* — Brent W Herring
(74) *Attorney, Agent, or Firm* — Goldstein Law Offices, P.C.

(57) ABSTRACT

A building construction system for creating a building structure upon a foundation slab having a top surface. An inner and outer rail are secured to the foundation slab. Walls are created upon the foundation slab including interior panels and exterior panels that are secured to the inner and outer rails respectively, and corner assemblies secured to both the inner and outer rails that together define a vertical interior space therebetween. The interior and exterior panels include standard, window, and door panels that together define a vertical interior space within the walls that is partially or fully filled with a structural fill such as concrete. Ceiling joists extend upon and are supported by the interior and exterior panels, to support ceiling panels. Rafter assemblies extend upon and are supported by the ceiling joists to support roofing panels.

8 Claims, 37 Drawing Sheets

(56) References Cited

U.S. PATENT DOCUMENTS 3,500,597 A * 3/1970 McKenzie ..... E04B 1/10 52/801.11
3,584,827 A * 6/1971 Shoemaker ..... E04G 11/12 249/196
4,835,928 A * 6/1989 Scott ..... E04B 1/4178 52/426
5,113,631 A * 5/1992 diGirolamo ..... E04B 1/24 52/236.8
5,195,293 A * 3/1993 diGirolamo ..... E04B 1/24 52/745.13
5,279,088 A * 1/1994 Heydon ..... E04B 1/0007 52/223.6
5,471,804 A 12/1995 Winter, IV
5,687,522 A * 11/1997 Durand ..... E04B 2/8635 249/113
5,861,105 A * 1/1999 Martineau ..... E04B 2/8652 249/190
5,992,114 A * 11/1999 Zelinsky ..... E04B 2/8652 249/216
6,519,904 B1 * 2/2003 Phillips ..... E04B 2/845 52/309.12
7,765,765 B1 * 8/2010 Perronne ..... E02D 27/02 52/309.11
7,934,351 B2 * 5/2011 Clarno ..... E04C 1/395 405/262
8,266,859 B1 * 9/2012 Harrington ..... E04B 2/8652 52/426
8,943,759 B2 2/2015 Warner et al.
8,950,132 B2 2/2015 Collins et al.
9,133,620 B1 * 9/2015 Huguet, Sr. ..... E04B 2/7448
2002/0078659 A1 * 6/2002 Hunt ..... E04B 1/04 52/745.13
2002/0095888 A1 * 7/2002 Winskye ..... E04B 1/24 52/234
2002/0134040 A1 * 9/2002 Hew ..... E04B 2/54 52/426
2003/0167713 A1 * 9/2003 Yost ..... E04B 2/8635 52/259
2005/0210764 A1 * 9/2005 Foucher ..... E04B 1/3445 52/79.5
2005/0247012 A1 * 11/2005 Williams ..... E04B 1/161 52/742.14
2011/0146181 A1 * 6/2011 Traulsen ..... E04B 2/94 52/474
2013/0074432 A1 * 3/2013 Ciuperca ..... E04B 1/21 52/309.4
2013/0119228 A1 * 5/2013 Kamata ..... E04B 2/8635 249/15
2014/0013678 A1 1/2014 Deverini
2016/0281355 A1 * 9/2016 McDonagh ..... E04B 2/02
2018/0044915 A1 * 2/2018 Castonguay ..... E04C 1/00

* cited by examiner

PRE-FABRICATED BUILDING CONSTRUCTION SYSTEM

TECHNICAL FIELD

The present disclosure relates generally to a construction system. More particularly, the present disclosure relates to a system for quickly and easily constructing a building structure using pre-fabricated components.

BACKGROUND

The largest expenses in construction are the cost of labor and the cost of materials. In the past, however, building materials were much more expensive than labor. Because the materials were so expensive, the so-called "pre-war" era in building construction emphasized spending significant man-hours to make the most of the materials being used. Thus, elaborate woodwork and plasterwork are typically found in "pre-war" buildings.

In modern construction, however, labor costs now greatly eclipse the cost of building materials. Industrialization has made building materials cheaper and has increased the average standard of living, thus increasing labor costs. Accordingly, during many standard construction operations, the labor cost can easily be ten times the cost of the materials used during a given time period of the operation.

The pace of construction has also slowed considerably due to the high demand for skilled labor. For example, once a building is framed, with the doors, windows, and electrical and plumbing systems installed, it may be ready for sheetrock installation. But if skilled sheetrockers are not available, all construction must wait—often days or weeks—until they become available. These delays can be costly to not only the general contractor, but also to the client.

Clearly, the path to reducing construction costs and increasing construction speed is to reduce the labor expenditure necessary to complete a given construction path. Labor costs and needs can be reduced by completing during manufacturing more of the tasks ordinarily performed on site. Labor costs and needs can be further reduced by lowering the skill level necessary to complete many on-site construction tasks.

Various systems have been devised and developed that seek to simplify construction processes using pre-fabricated components. While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a building construction system that reduces the cost and increases the speed of construction. Accordingly, the present disclosure provides a building construction system that employs pre-fabricated components that are easy to assemble and minimize on-site construction tasks.

It is another aspect of an example embodiment in the present disclosure to provide a building construction system that reduces the need for skilled labor on a construction site. Accordingly, with a significant portion of construction tasks already handled in the manufacturing stage, the pre-fabricated component may be easily installed at a significantly reduced labor cost.

Accordingly, the present disclosure describes a building construction system for creating a building structure upon a foundation slab having a top surface. An inner rail and an outer rail are secured to the foundation slab. Walls are created upon the foundation slab including interior panels and exterior panels that are secured to the inner and outer rails respectively, and corner assemblies secured to both the inner and outer rails that together define a vertical interior space therebetween. The interior and exterior panels include standard, window, and door panels that together define a vertical interior space within the walls that is partially or fully filled with a structural fill such as concrete. Ceiling joists extend upon and are supported by the interior and exterior panels, to support ceiling panels. Rafter assemblies extend upon and are supported by the ceiling joists to support roofing panels.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 25A:
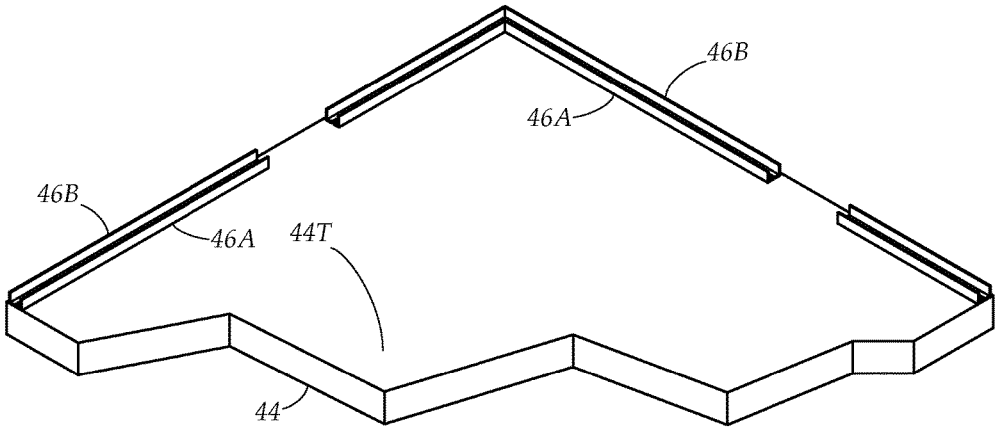
FIG. 25A is a diagrammatic perspective view, illustrating an initial step in construction of a building structure in accordance with the principles of the present disclosure, wherein panel securing rails are secured to the foundation.
Figure 25B:
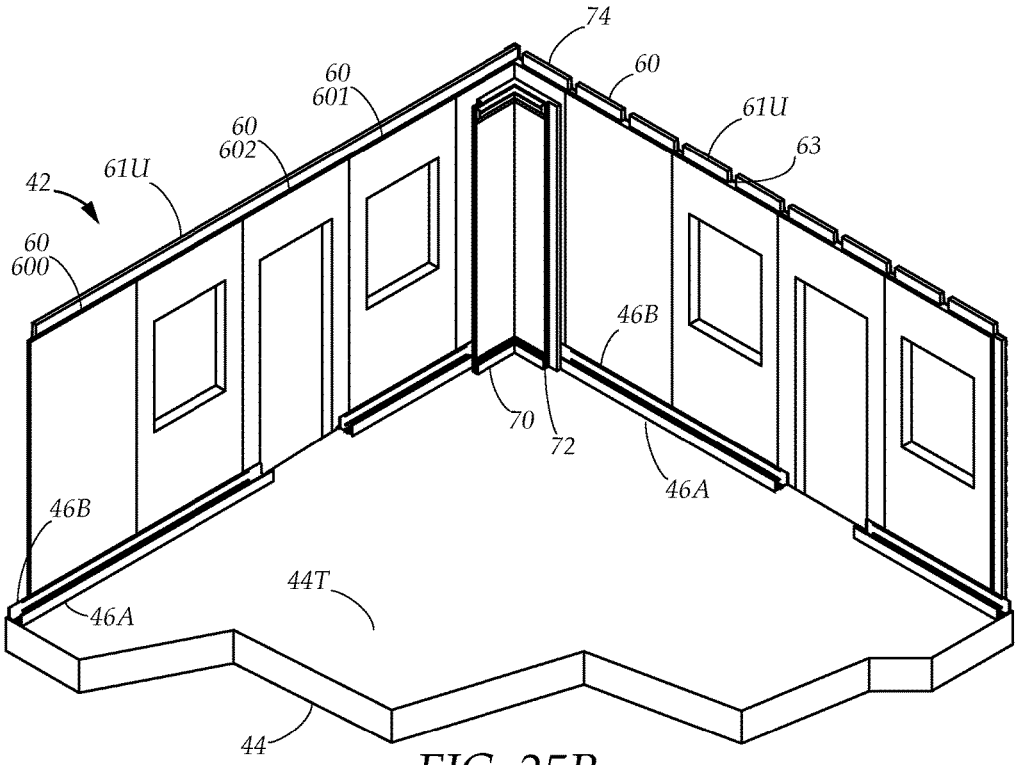
FIG. 25B is a diagrammatic perspective view, illustrating further steps in construction of the building, wherein one of the corner assemblies and various exterior panels are secured to the panel securing rails.
Figure 25C:
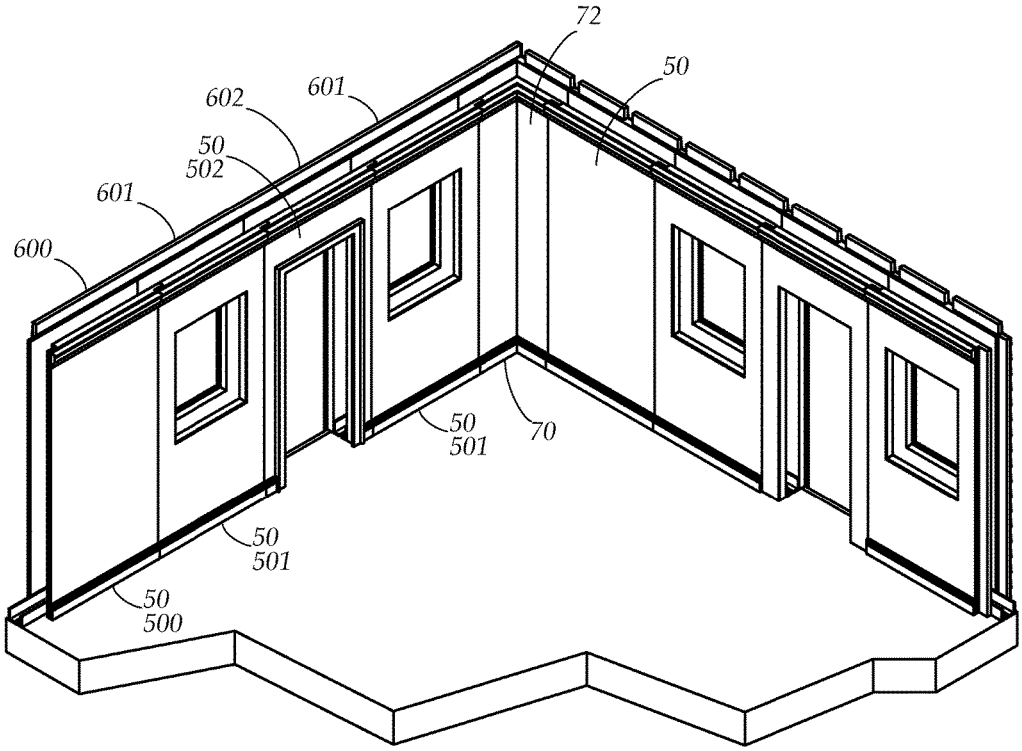
FIG. 25C is a diagrammatic perspective view, illustrating further steps in construction of the building, wherein various interior panels are secured to the panel securing rails.
Figure 25D:
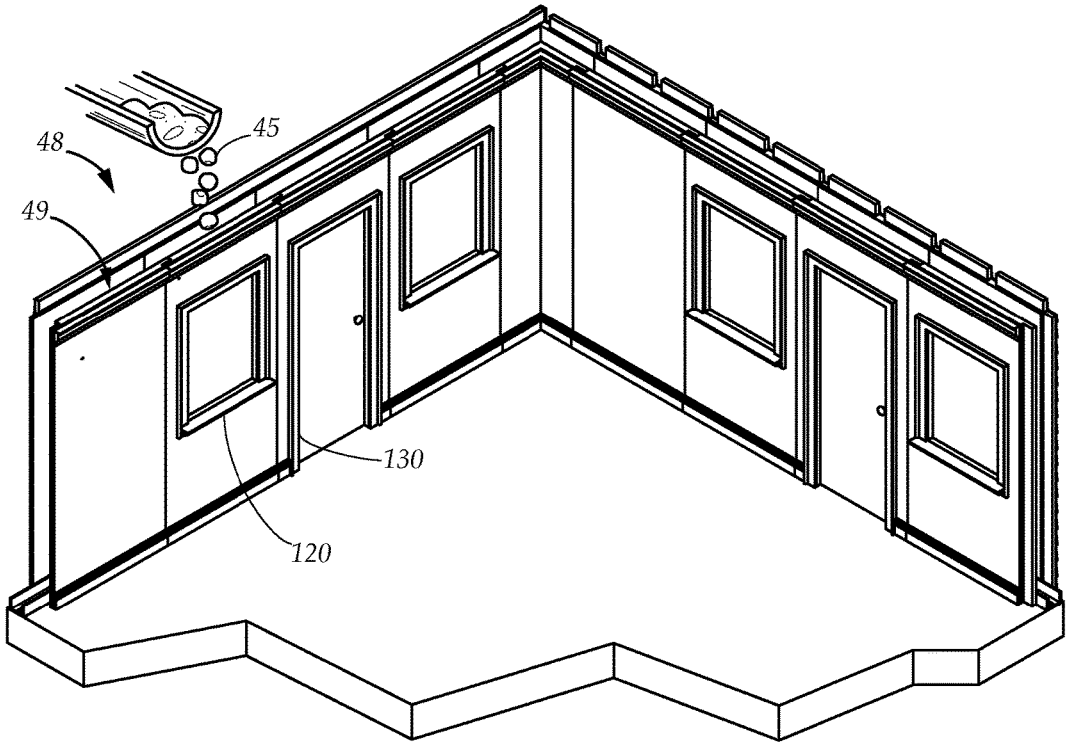
FIG. 25D is a diagrammatic perspective view, illustrating further steps in construction of the building, wherein the vertical interior space between the interior and exterior panels is filled with concrete.
Figure 25E:
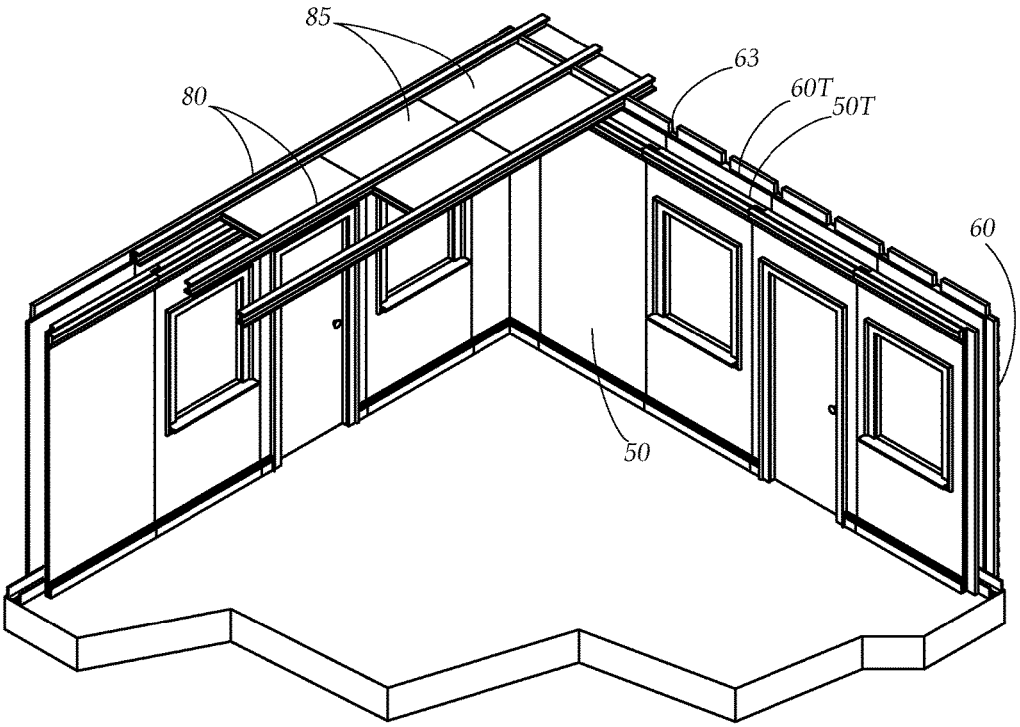
FIG. 25E is a diagrammatic perspective view, illustrating further steps in construction of the building, wherein ceiling joists and ceiling panels are secured atop the walls.
Figure 25F:
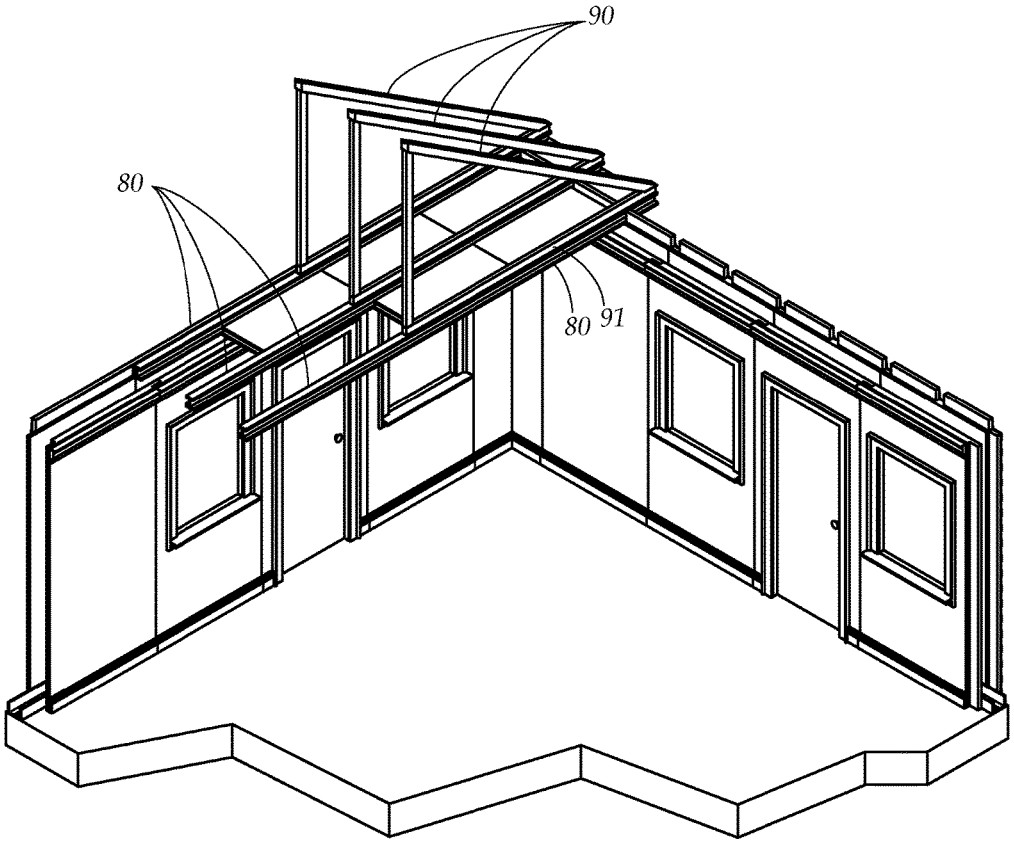
FIG. 25F is a diagrammatic perspective view, illustrating further steps in construction of the building, wherein the rafter assemblies are attached above the ceiling joists.
Figure 25G:
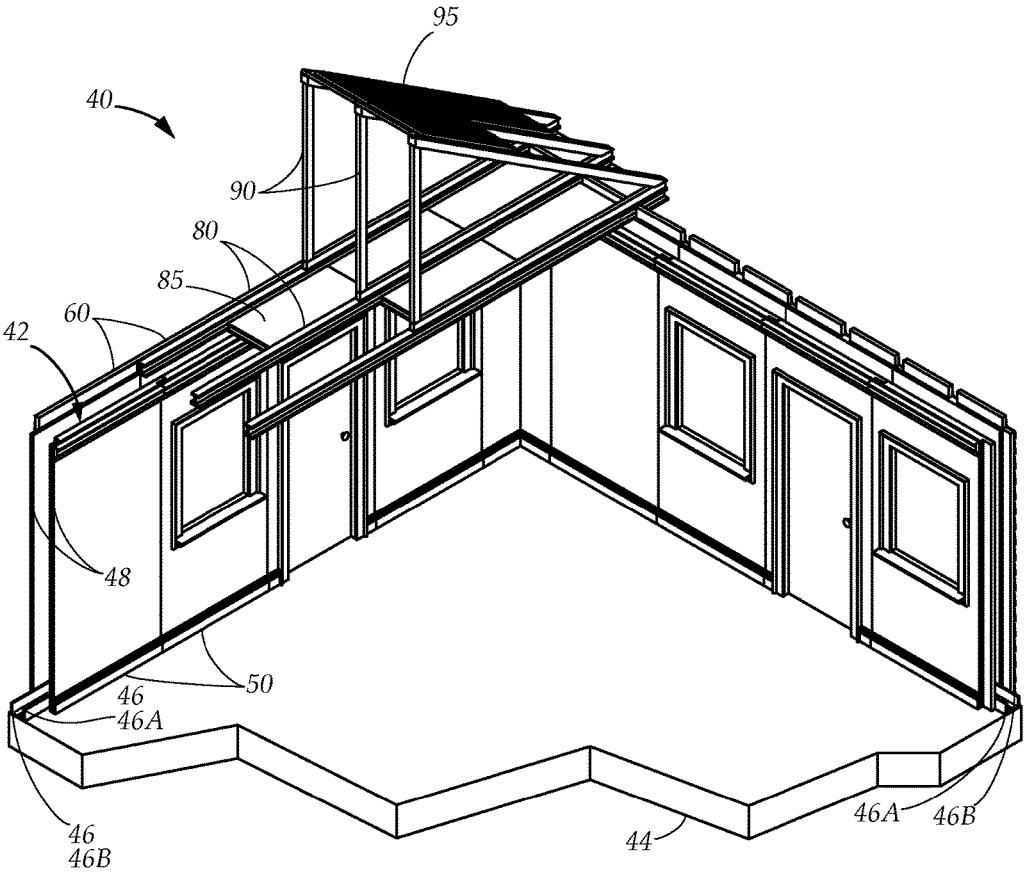
FIG. 25G is a diagrammatic perspective view, illustrating further steps in construction of the building, wherein roofing panels are attached to the rafter assemblies.

FIG. 25G illustrates major components and provides an overview of a pre-fabricated construction system 40 in accordance with the present disclosure, for constructing a building 42 upon a foundation—namely a horizontally extending slab 44. In particular, secured to the slab 44 are panel securing rails 46, including an inner rail 46A and an outer rail 46B that extend parallel to each other. A plurality of interior panels 50 are attached to the inner rail 46A, and a plurality of exterior panels 60 are attached to the outer rail 46B. Corner assemblies 70 are secured to both the inner rail 46A and outer rail 46B. The interior panels 50, exterior panels 60, and corner assemblies 70 together form walls 48 that may be partially or fully filled with a structural fill such as concrete. Ceiling joists 80 extend atop the walls 48 and support ceiling panels 85. Rafter assemblies 90 are supported by the ceiling joists 80 and support roofing panels 95.

Figure 10A:
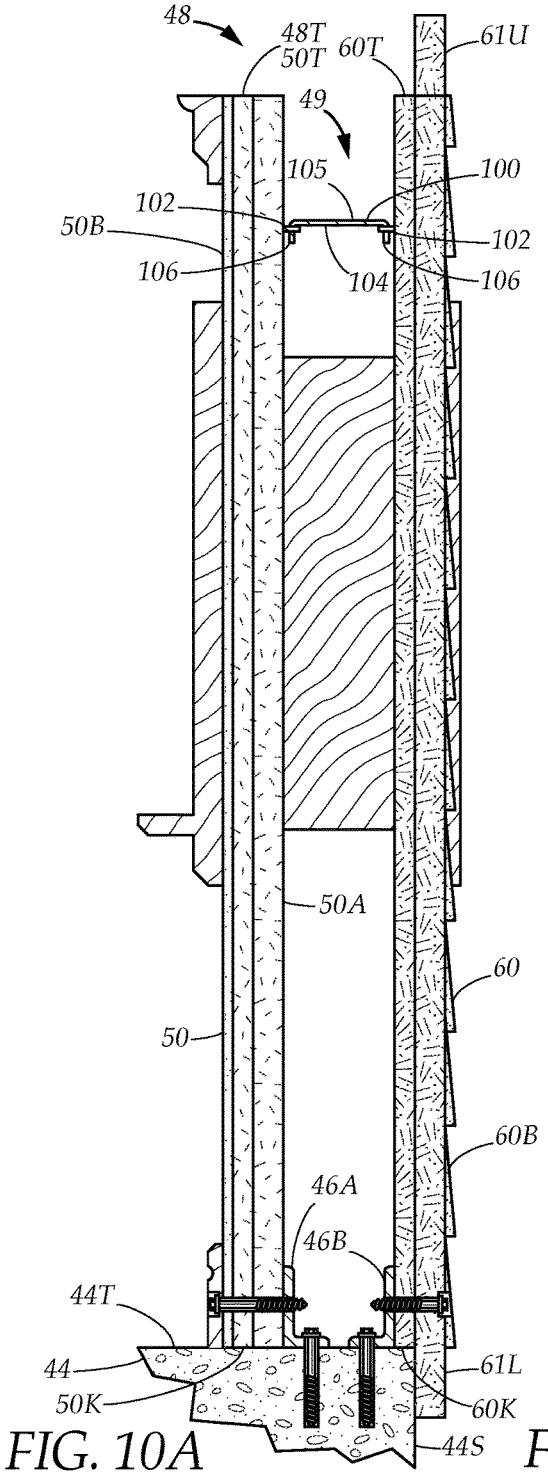
FIG. 10A is a side elevational view with parts broken away, illustrating an exterior panel and an interior panel secured to the foundation slab through the panel securing rails, and connected together.
Figure 10B:
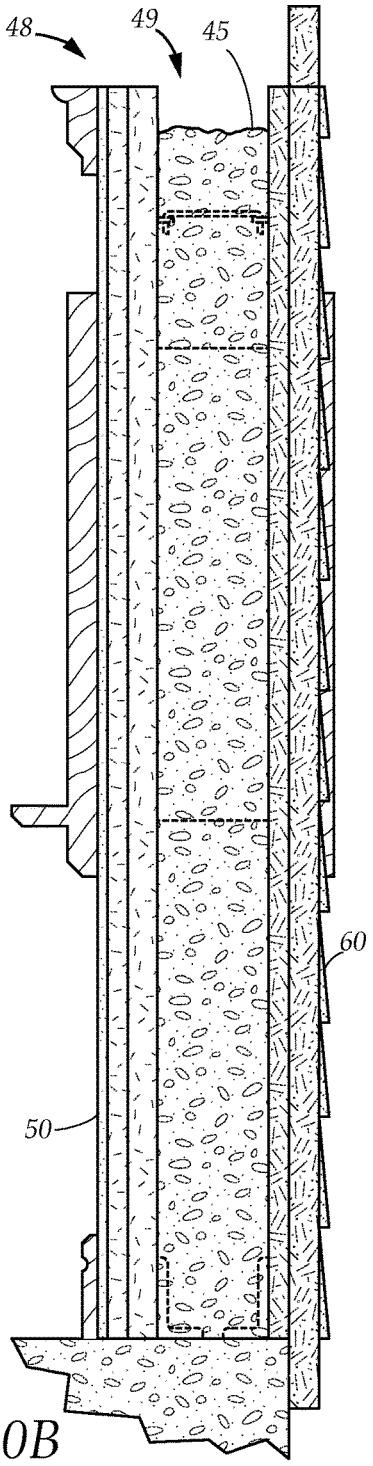
FIG. 10B is a side elevational view with parts broken away, illustrating the exterior panel and an interior panel secured to the foundation slab through the panel securing rails, connected together, and filled with concrete.

FIG. 10A provides an overview of construction of the walls 48. In particular, in the portion of the wall 48 illustrated, one of the interior panels 50 is shown evenly spaced from one of the exterior panels 60. The interior panel 50 has an interior face 50A and an exterior face 50B, and the exterior panel 60 has an interior face 60A and an exterior face 60B. The interior panel 50 has a top edge 50T and a bottom edge 50K, and the exterior panel 60 has a top edge 60T and a bottom edge 60K. The concrete slab 44 has a top surface 44T and a side surface 44S. The bottom edges 50K, 60K of the interior panel 50 and exterior panel 60 rest upon the top surface 44T of the slab 44. The interior panel 50 is fastened to the inner rail 46A near its bottom edge 50K, and the exterior panel 60 is fastened to the outer rail 46B near its bottom edge 60K. The interior and exterior panels 50, 60 extend vertically, and are equidistant apart, thereby defining a vertical interior space 49 between the interior faces 50A, 60A thereof. The parallel nature of the interior and exterior panels 50, 60 is maintained by virtue of their attachment to the rails 46A and 46B near their bottom edges 50K, 60K, and held in position at least temporarily by a connecting assembly 100 near the top edges 50T, 60T. Referring to FIG. 10B, within the wall 48 this vertical interior space 49 may be filled partially or entirely with a structural fill, such as concrete 45. Once the wall 48 is filled with concrete 45, the panels 50, 60 are effectively stabilized, and their relative positions permanently established.

Figure 11:
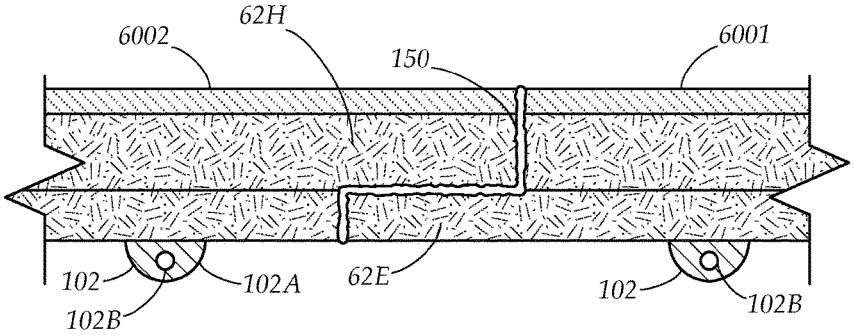
FIG. 11 is a top plan view, illustrating two adjacent exterior panels joined together.

The connecting assembly 100, as seen in FIG. 10A, includes a pair of connecting brackets 102, and a connecting bar 104. The connecting bar 104 has a main part 105, and a pair of ends 106 that extend perpendicular to the main part 105 and parallel to each other. The interior faces 50A, 60A of the interior panel 50 and exterior panel 60 each have a connecting bracket 102 in a complementary position so that the connecting brackets 102 face each other across the vertical interior space 49. Referring momentarily to FIG. 11, each connecting bracket 102 has a horizontal flange 102A that projects horizontally inward from the interior face 50A, and has a vertical bore 102B for accommodating one of the ends 106 of one of the connecting bars 104 (FIG. 10A).

Figure 6:
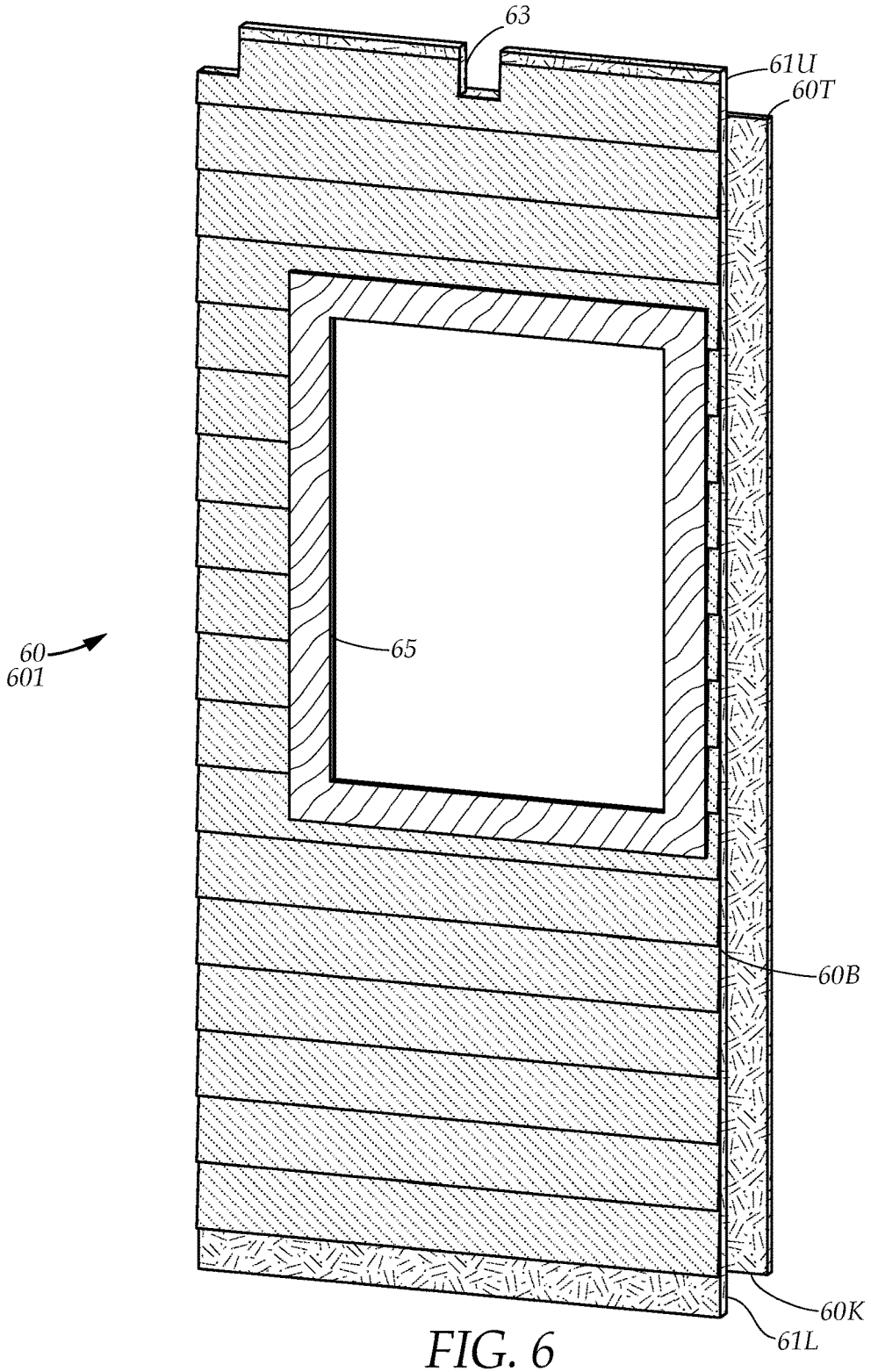
FIG. 6 is a diagrammatic perspective view, showing an exterior face of an exterior panel having a window cutout.
Figure 7:
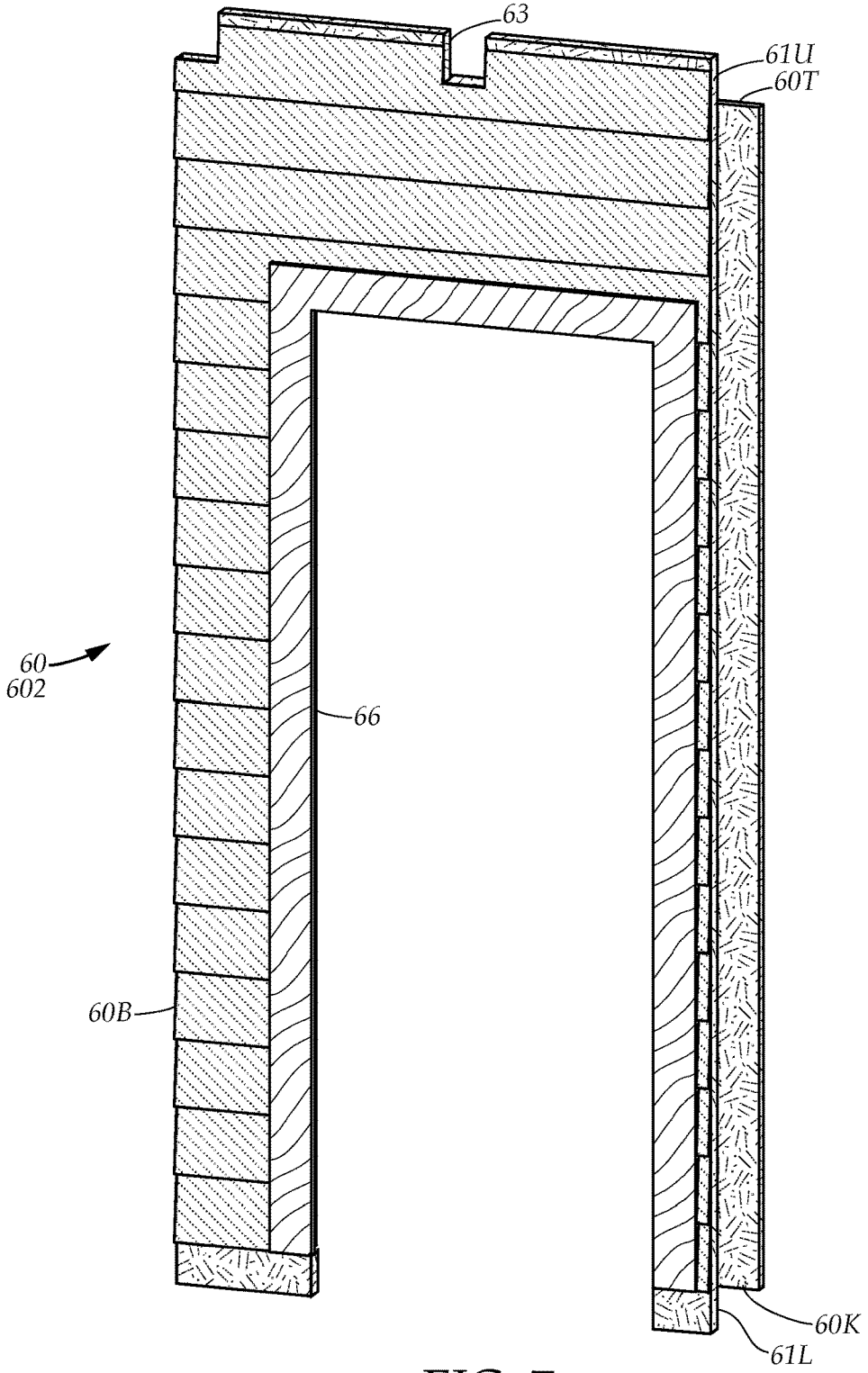
FIG. 7 is a diagrammatic perspective view, showing an exterior face of an exterior panel having a door cutout.

Also illustrated in FIG. 10A, the interior face 50A and exterior face 50B of the interior panel 50 are aligned at the bottom edge 50K. For the exterior panel 60, however, only the interior face 60A has the bottom edge 60K that rests upon the top surface 44T of the slab 44. The exterior face 60B, has a lower extension 61L that extends below the bottom edge 60K of the exterior panel 60B (also see FIG. 5, FIG. 6, and FIG. 7) and thereby extends below the top surface 44T of the slab 44. Instead, the lower extension 61L exterior face 60B extends alongside and against the side surface 44S of the slab 44. Similarly, the interior face 50A and exterior face 50B of the interior panel 50 are aligned at the top edge 50T, which may also be considered a top edge 48T of the wall 48. The interior face 60A of the exterior panel 60 also has the top edge 60T of the exterior panel 60, which is equivalent with the top edge 48T of the wall 48. The exterior face 60B, however, has an upper extension 61U that extends above the top edge 60T of the exterior panel 60 (also see FIG. 5, FIG. 6, and FIG. 7) and top edge 48T of the wall 48. Also note in FIG. 5, FIG. 6, and FIG. 7 that some of the exterior panels 60 may have notch openings 63 spaced laterally at a substantially equal distance in the upper extension 61U to accommodate the ceiling joists 80 (see FIG. 25G). Preferably the notch openings 63 extend downwardly to the top edge 60T of the exterior panel 60. Note that some other exterior panels 60 do not have notch openings 63.

Figure 1A:
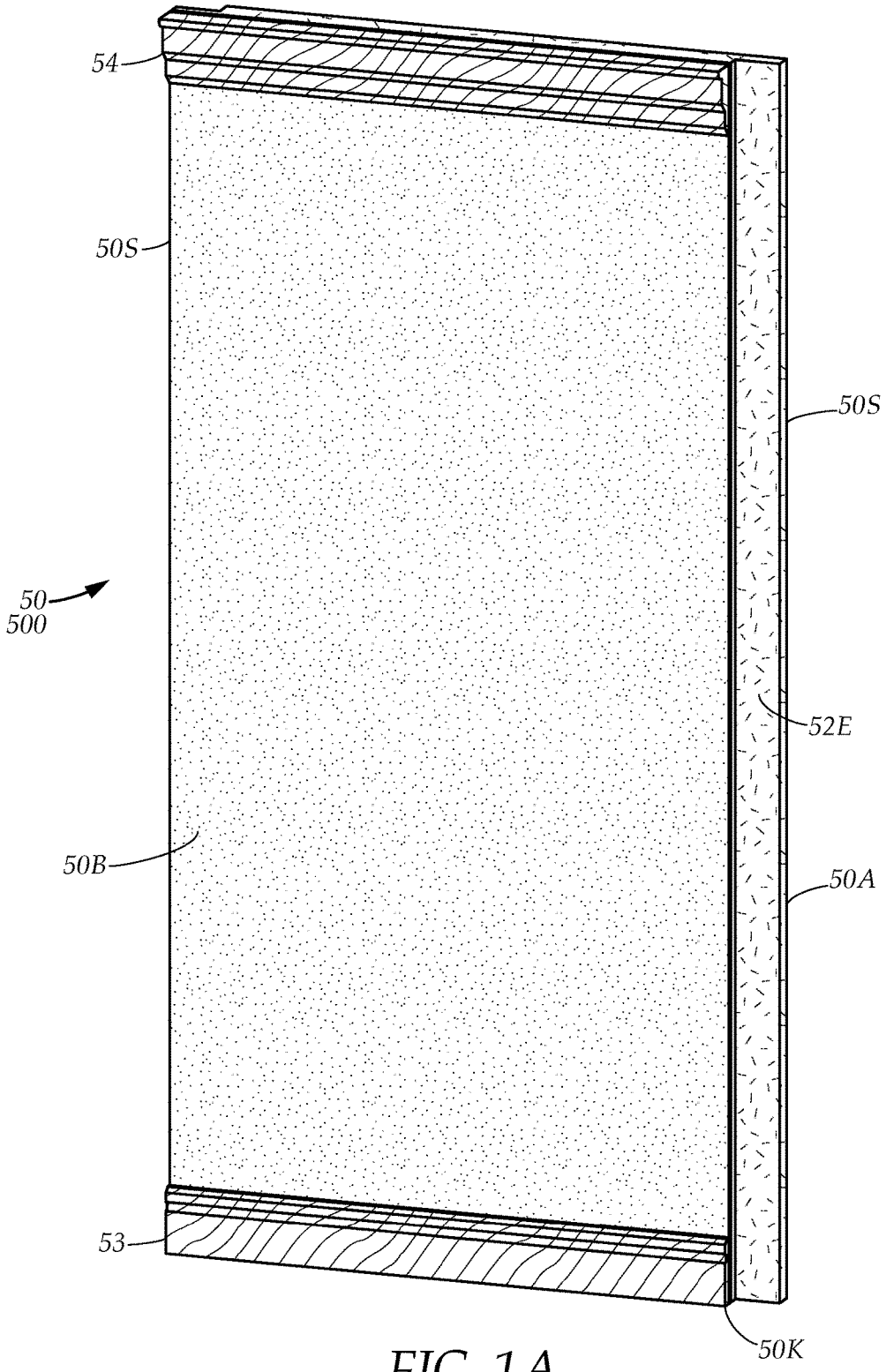
FIG. 1A is diagrammatic perspective view, showing an exterior face of an embodiment of an interior panel, in accordance with the principles of the present disclosure.
Figure 1B:
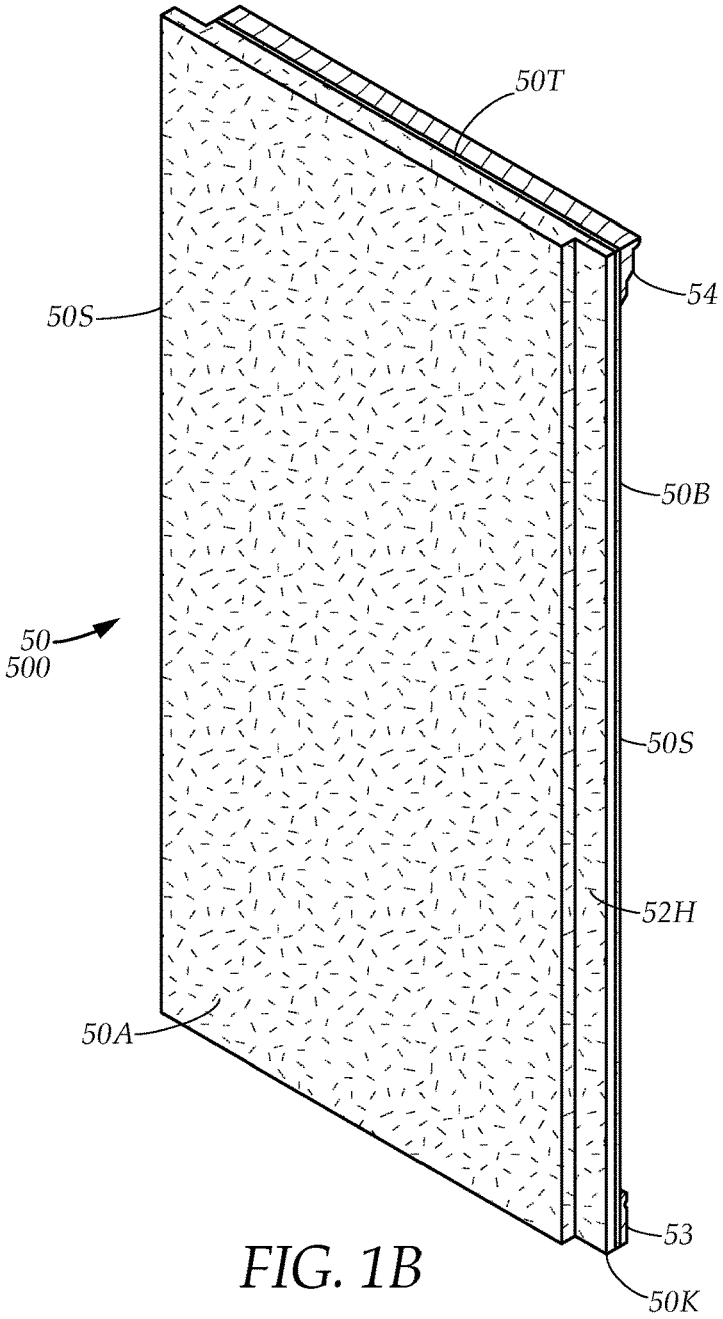
FIG. 1B is a diagrammatic perspective view, showing an interior face of the interior panel.
Figure 1C:
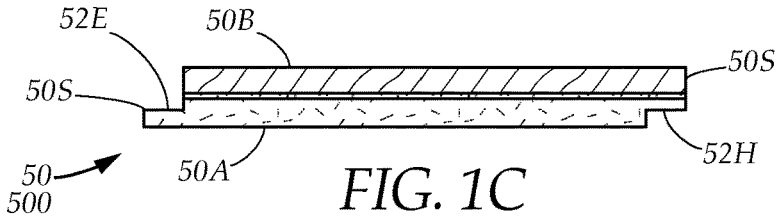
FIG. 1C is a top plan view of the interior panel.
Figure 5:
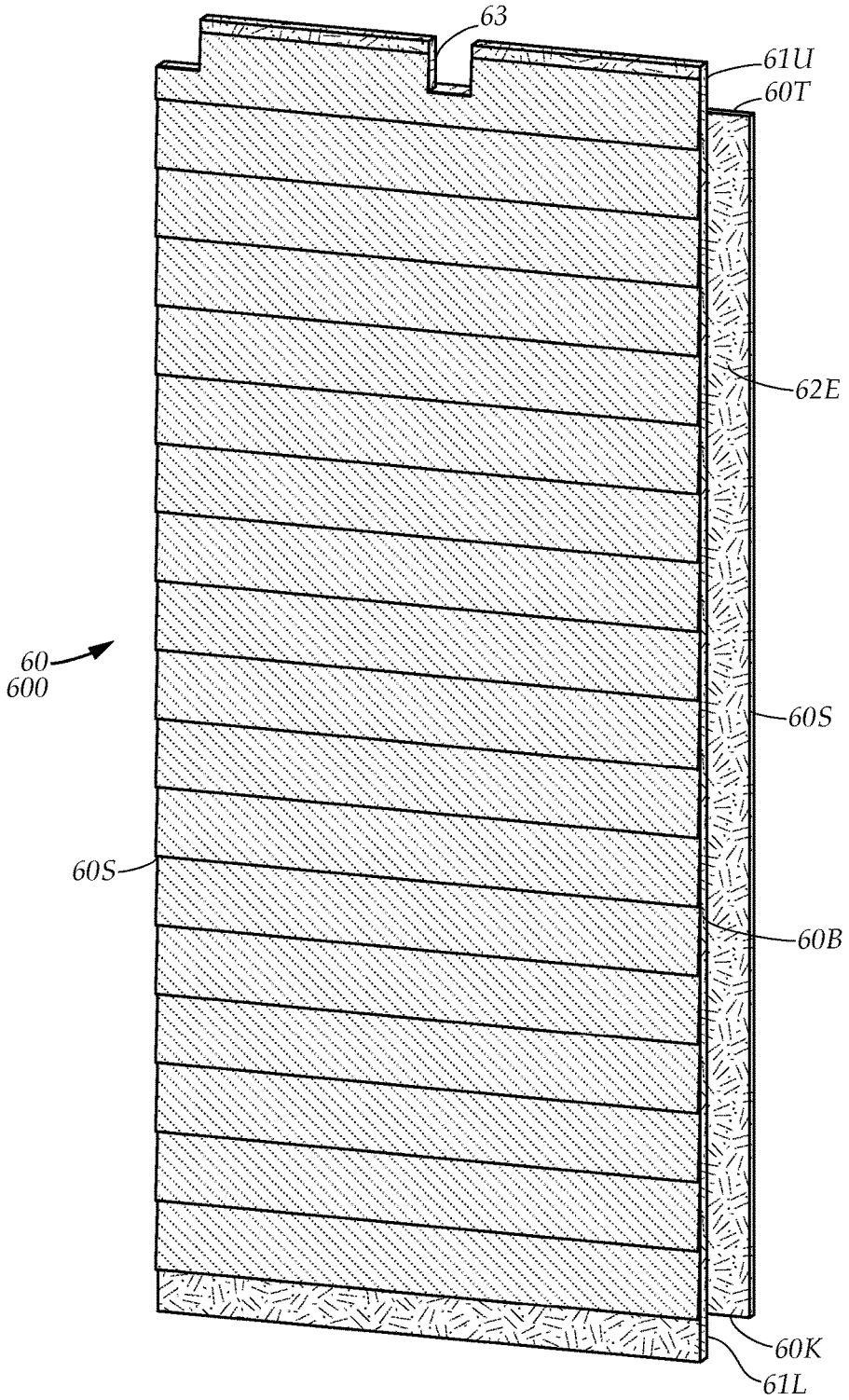
FIG. 5 is a diagrammatic perspective view, showing an exterior face of an exterior panel.
Figure 13A:
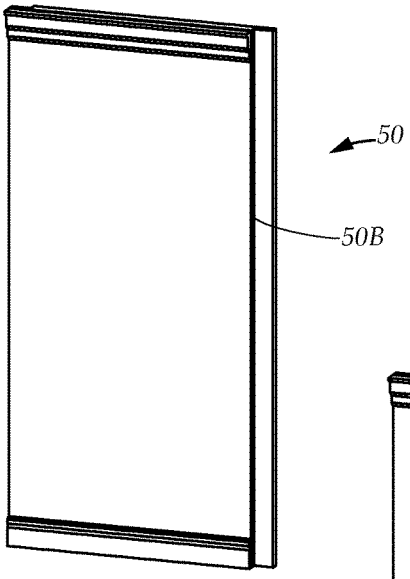
FIGS. 13A, 13B, and 13C are diagrammatic perspective views, each showing an example of a version of the interior panel and demonstrating the adaptability of the panel system to any desired décor, style or finish materials.
Figure 13B:
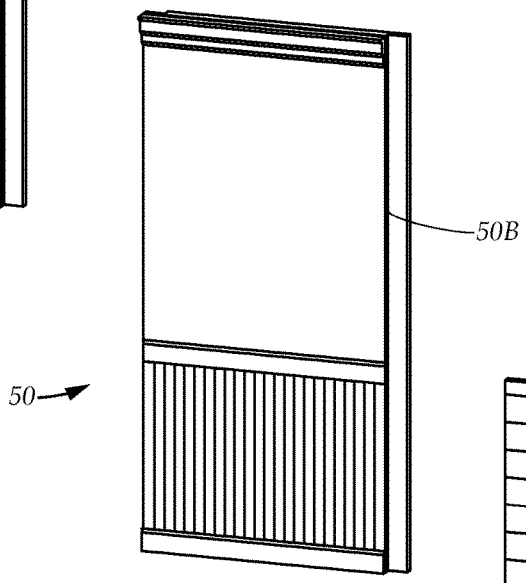
Figure 13C:
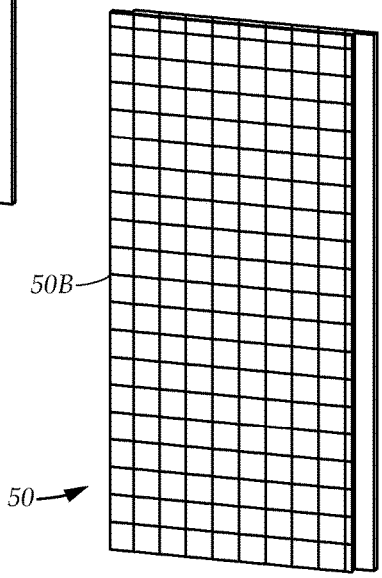
Figure 14A:
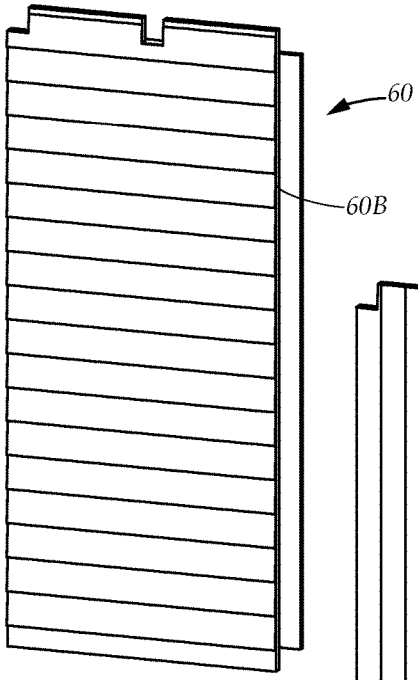
FIGS. 14A, 14B, and 14C are diagrammatic perspective views, each showing an example of a version of the exterior panel and demonstrating the adaptability of the panel system to any desired building style or building materials.
Figure 14B:
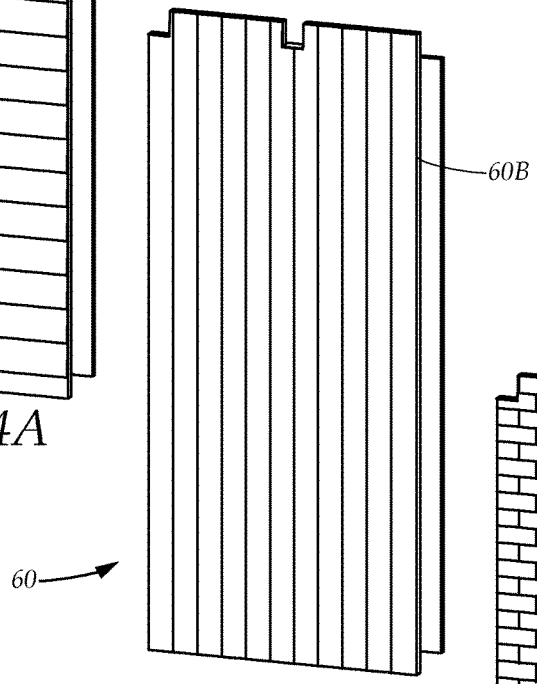
Figure 14C:
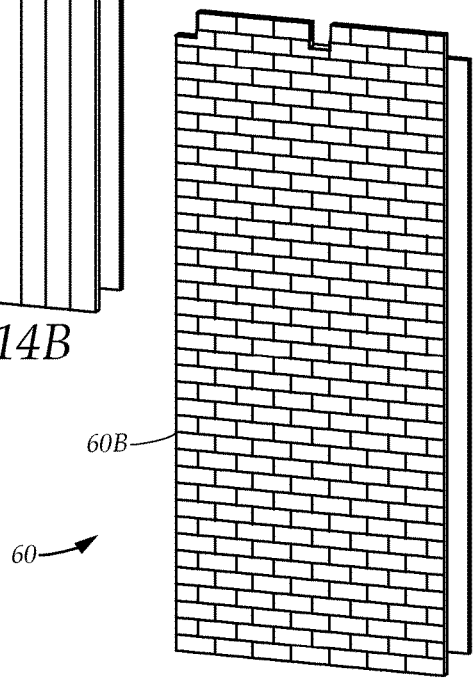

FIGS. 1A, 1B, and 10 show an example of one of the interior panels 50, which may be considered a standard interior panel 500. The interior panel 50 has a pair of lateral sides 50S. The interior panels 50 may be configured to overlap with adjacent interior panels 50, such that an exposed overlap 52E is formed at one of the lateral sides 50S and a hidden overlap 52H is formed at the other of the lateral sides 50S. In particular, at the lateral side 50S with the exposed overlap 52E, the interior face 50A extends further laterally than the exterior face 50B. At the lateral side 50S with the hidden overlap 52H, the exterior face 50B extends further laterally than the interior face 50A. The hidden overlap 52H and the exposed overlap 52E both preferably extend laterally by the same distance, as the overlaps 52H, 52E facilitate adjacent panels 50 fitting neatly together. In particular, the exterior face 50B may include a base molding 53 near the bottom edge 50K and a crown molding 54 near the top edge 50T. The base moldings 53 and crown moldings 54 substantially extend between the lateral sides 50S, but more particularly, they extend fully to the lateral side 50S having the hidden overlap 52H, yet stop at the exposed overlap 52H. Referring momentarily to FIG. 12D, this arrangement ensures that the moldings 53, 54 abut each other when the hidden overlap 52H of one interior panel 50 meets the exposed overlap 52E of an adjacent interior panel 50. Note that the exterior face 50B of the interior panel 50 can include any suitable interior finish material, including flat panel as shown in FIG. 13A, wainscoting with a chair rail as shown in FIG. 13B, tiled as shown in FIG. 13C, or any other natural or manufactured material desired. Complementary to the interior panel 50 is the exterior panel 60, shown in FIG. 5—namely a standard exterior panel 600. The exterior panel 60 has a pair of lateral sides 60S, one of which has a hidden overlap 62H (better seen in FIG. 12A), and other lateral side has an exposed overlap 62E. Note that the exterior face 60B of the exterior panel 60 can include any suitable exterior building material, such as horizontal wood or vinyl slats as shown in FIG. 5 and in FIG. 14A, as well as vertical boards as shown in FIG. 14B, simulated or actual brick as shown in FIG. 14C, stone, stucco, or the like.

Figure 2A:
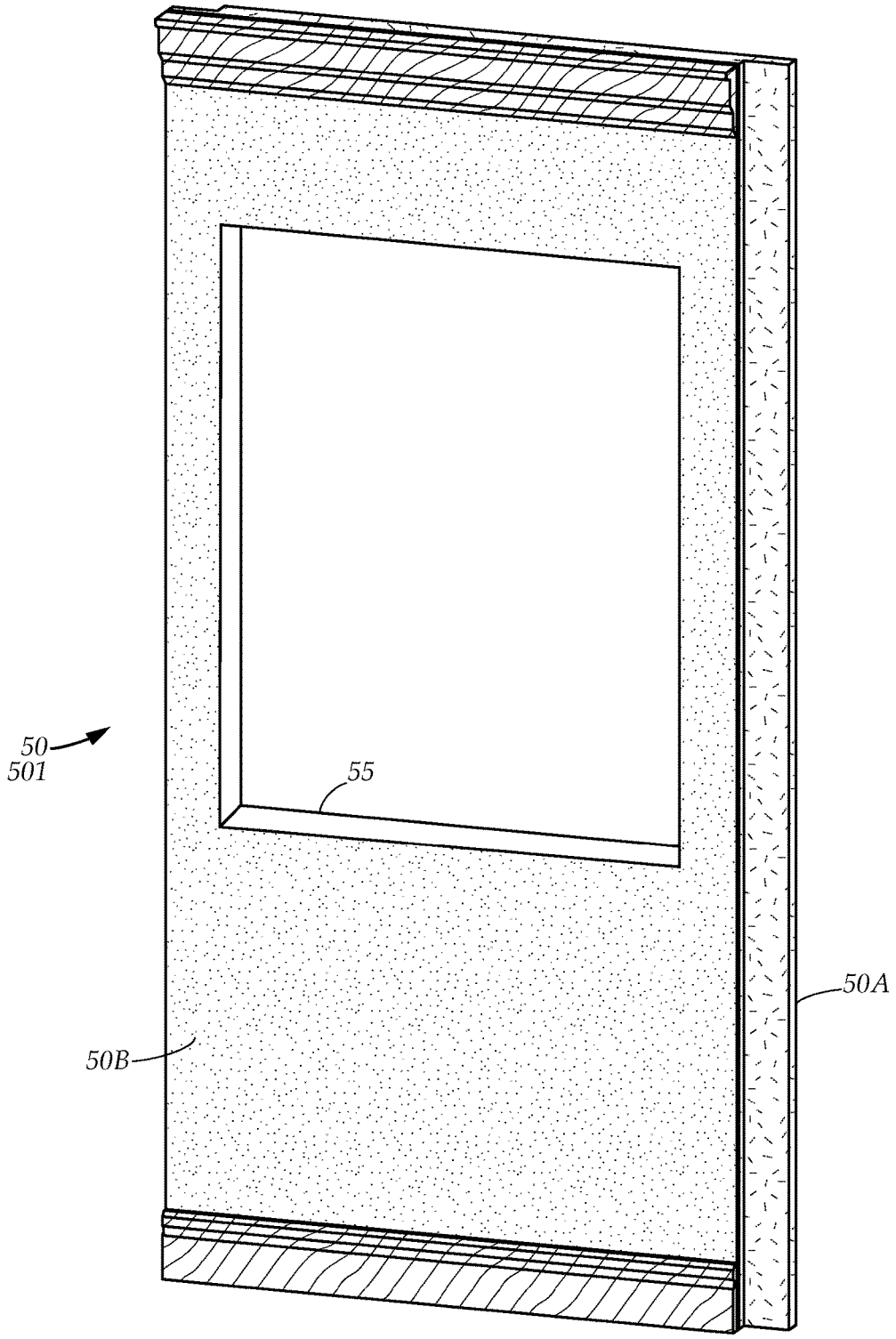
FIG. 2A is a diagrammatic perspective view, showing an exterior face of an embodiment of an interior panel having a window cutout.
Figure 2B:
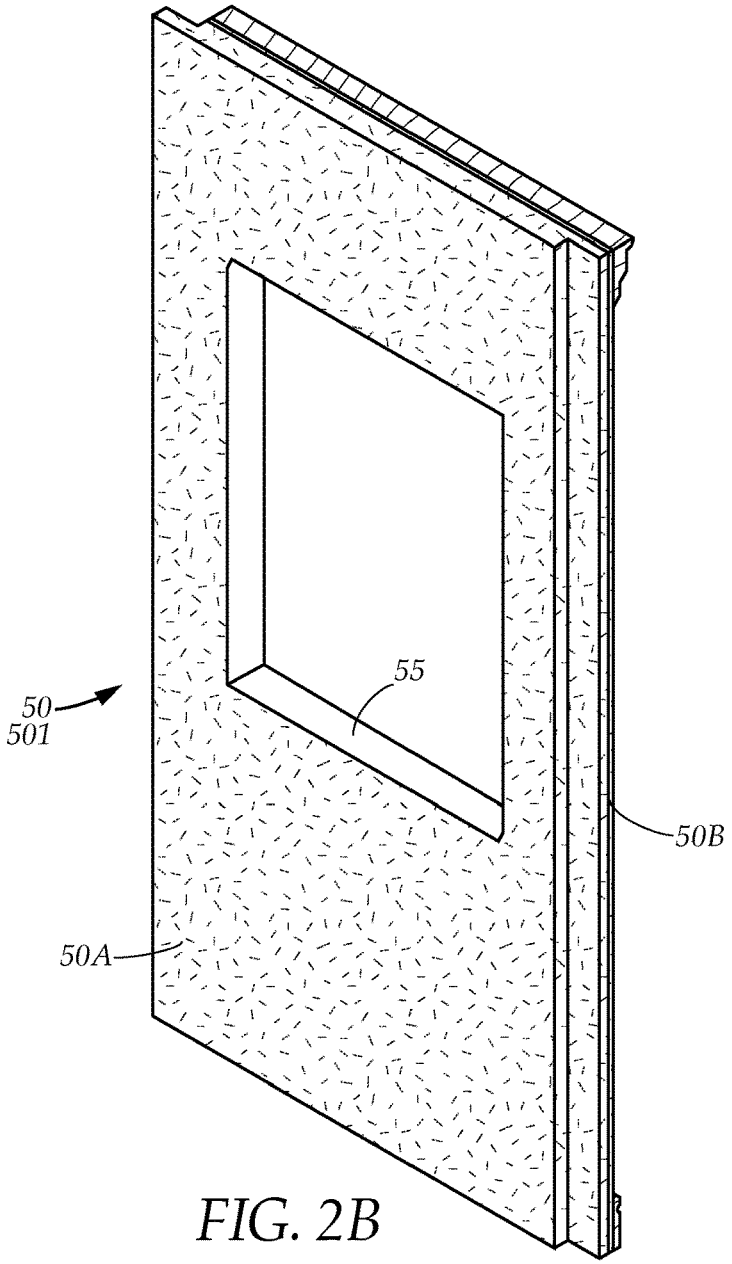
FIG. 2B is a diagrammatic perspective view, showing an interior face of the interior panel having a window cutout.
Figure 2C:
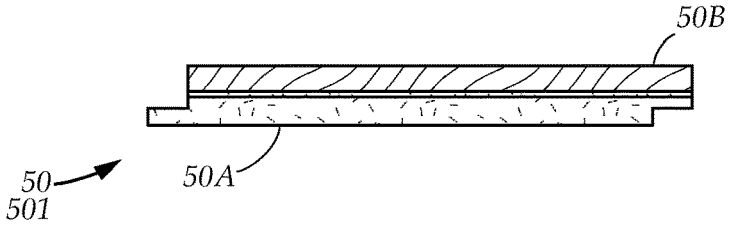
FIG. 2C is a top plan view of the interior panel having a window cutout.
Figure 16:
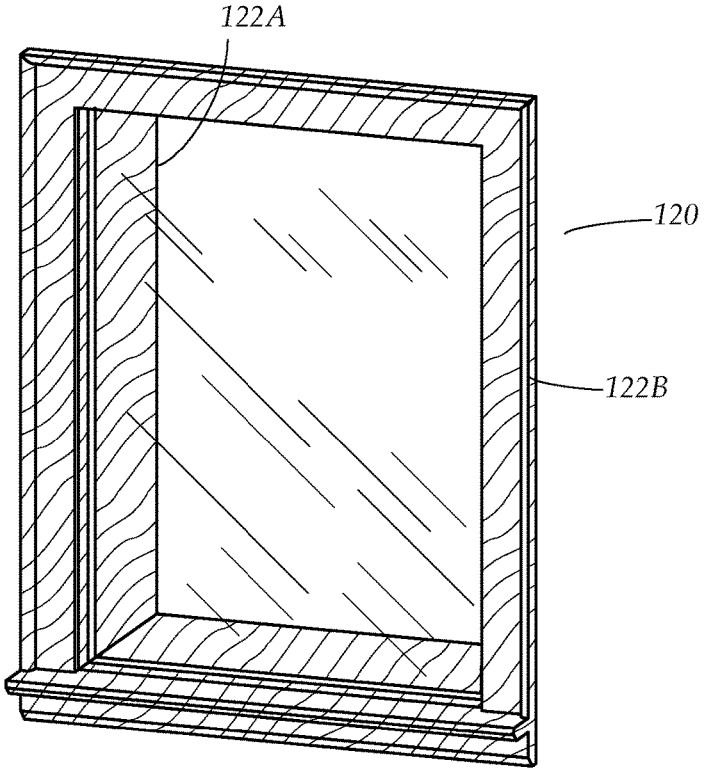
FIG. 16 is a diagrammatic perspective view, illustrating a window unit for use with the building system described herein.
Figure 16A:
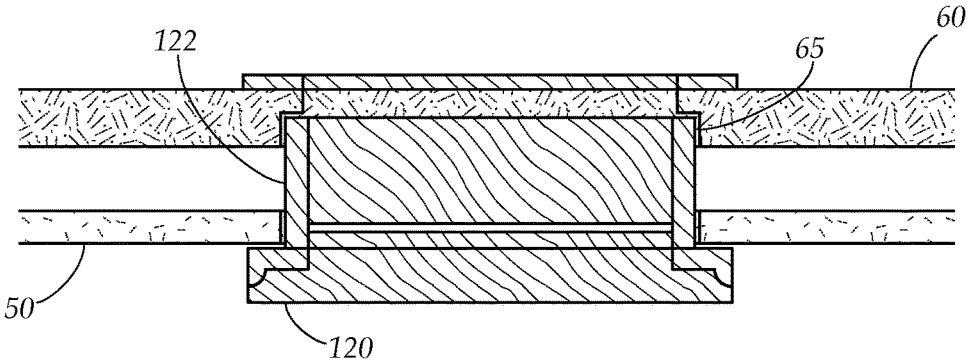
FIG. 16A is a top plan view with parts broken away, illustrating installation of the window unit within the interior and exterior panels.

FIGS. 2A, 2B, and 2C show another example of one of the interior panels 50. In particular, this interior panel 50 is a window interior panel 501, which has a substantially rectangular window opening 55 that extends fully through the interior face 50A and exterior face 50B. Complementary to the window interior panel 501 is a window exterior panel 601, shown in FIG. 6, that contains a substantially rectangular window opening 65. Referring momentarily to FIG. 16, a window unit 120 is illustrated, including a window frame 122 having an external part 122B and an internal part 122A. Referring to FIG. 16A, when the window unit 120 is installed, it is preferably installed first through the interior panel 50, and then into and abutting the exterior panel 60. Note that the window opening 65 in the exterior panel 60 is preferably notched with a window seat 65A that snugly accommodates the window frame 122 and prevents the window unit 120 from travelling further outwardly.

Figure 3A:
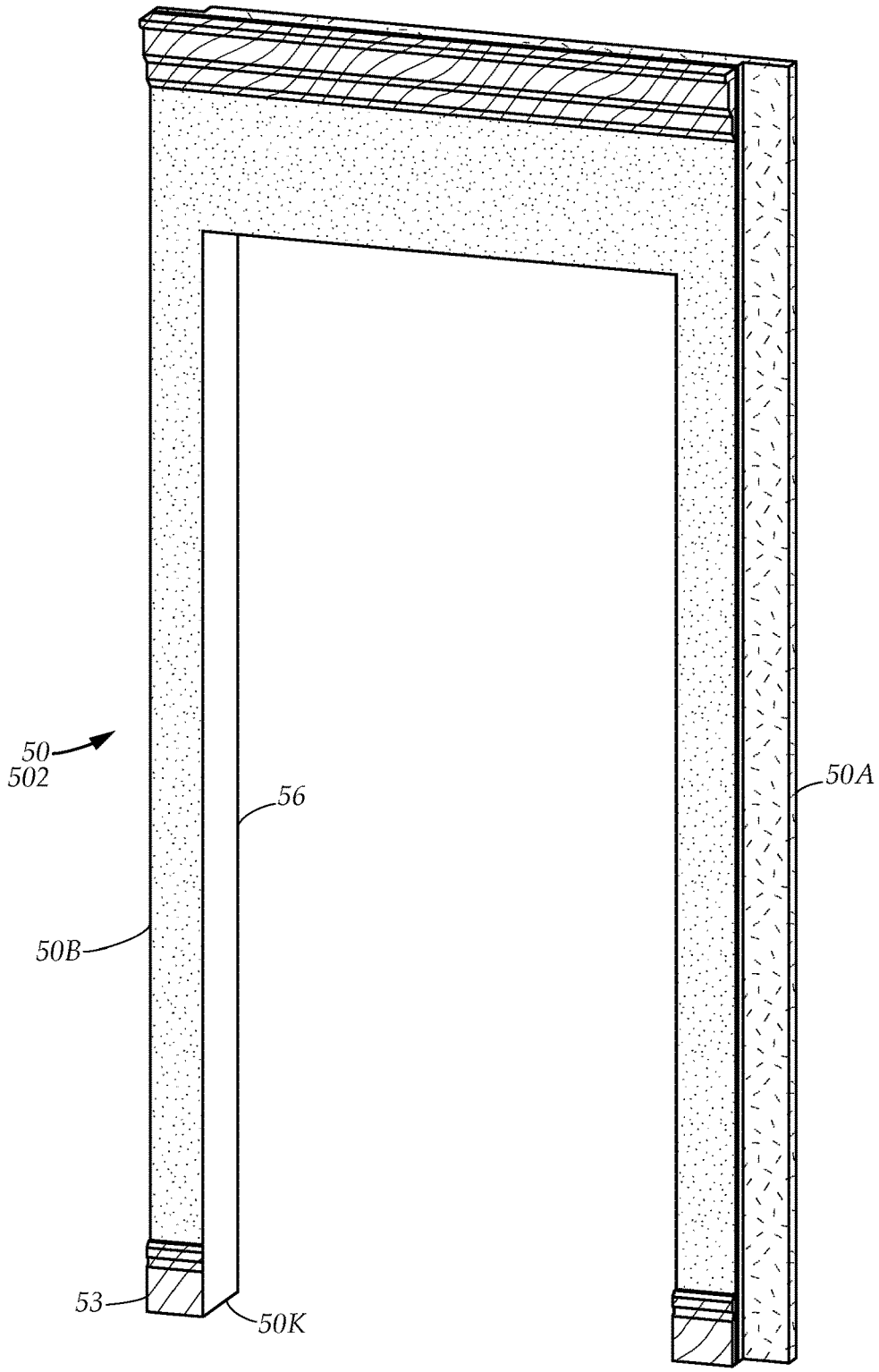
FIG. 3A is a diagrammatic perspective view, showing an exterior face of an embodiment of an interior panel having a door cutout.
Figure 3B:
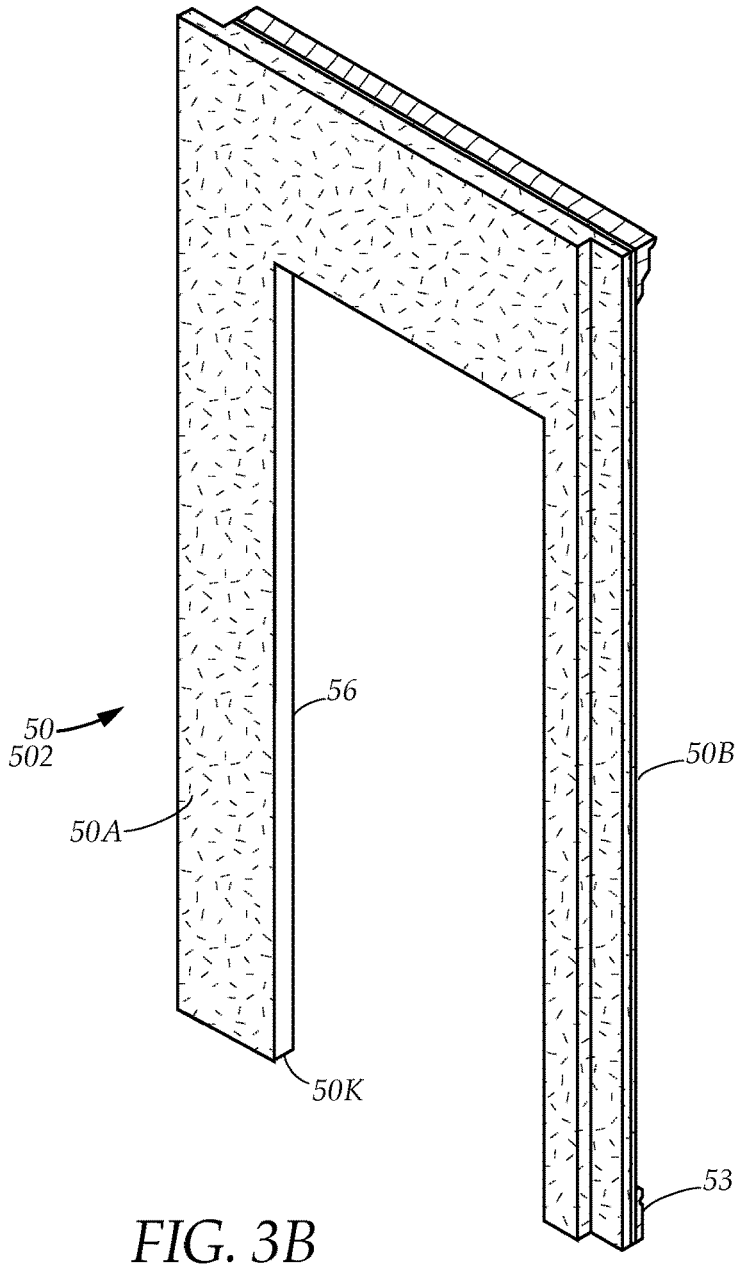
FIG. 3B is a diagrammatic perspective view, showing an interior face of the interior panel having a door cutout.
Figure 3C:
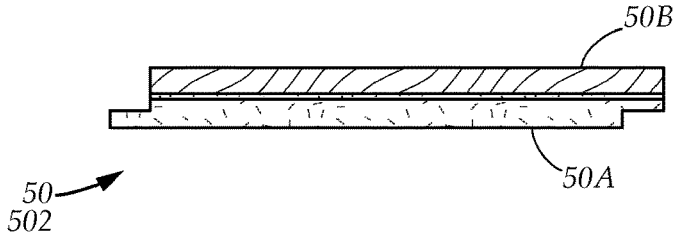
FIG. 3C is a top plan view of the interior panel having a door cutout.
Figure 15:
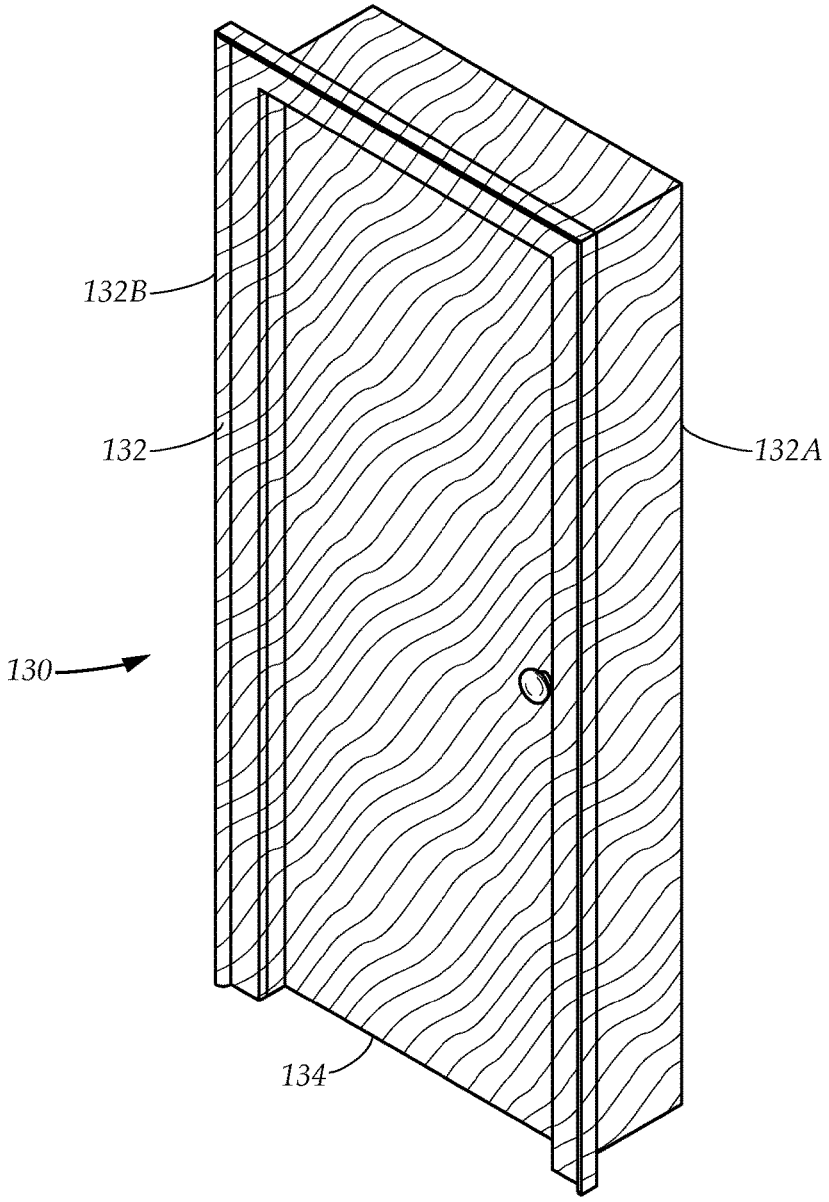
FIG. 15 is a diagrammatic perspective view, illustrating a door unit for use with the building system described herein.
Figure 15A:
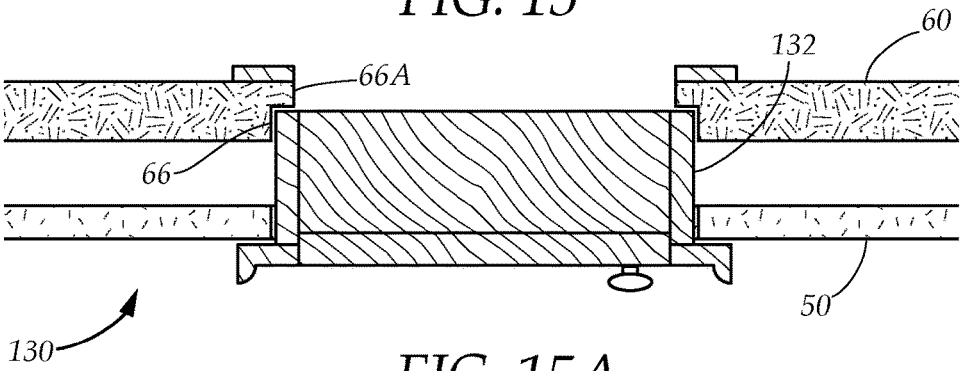
FIG. 15A is a top plan view with parts broken away, illustrating installation of the door unit within the interior and exterior panels.

FIGS. 3A, 3B, and 3C show a further example of one of the interior panels 50. In particular, this interior panel 50 is a door interior panel 502, which has a substantially rectangular door opening 56 that extends fully through the interior face 50A and exterior face 50B of the interior panel 50, and also breaches the bottom edge 50K, as well as interrupting the base molding 53. Complementary to the door interior panel 502 is a door exterior panel 602, shown in FIG. 7, that contains a substantially rectangular door opening 66. Referring momentarily to FIG. 15, a door unit 130 is illustrated, including a door frame 132 having an external part 132B and an internal part 132A, and a door 134 extending within the door frame 132. Referring to FIG. 15A, when the door unit 130 is installed, it is preferably installed first through the interior panel 50, and then into and abutting the exterior panel 60. Note that the door opening 66 in the exterior panel 60 is preferably notched with a door seat 66A that snugly accommodates the door frame 132 and prevents the door unit 130 from travelling further outwardly.

Figure 8:
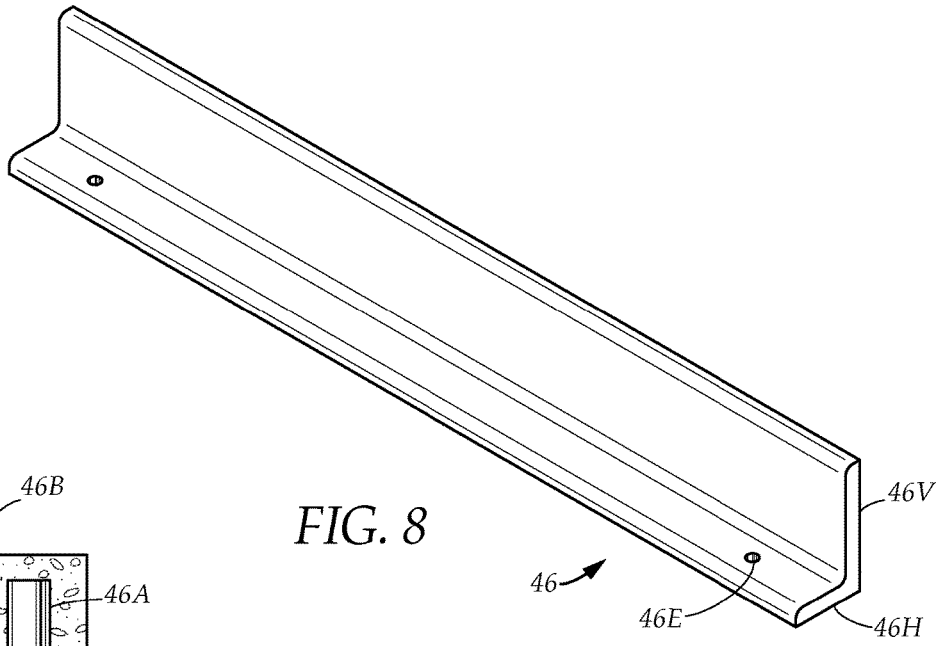
FIG. 8 is a diagrammatic perspective view, showing a panel securing rail.
Figure 9A:
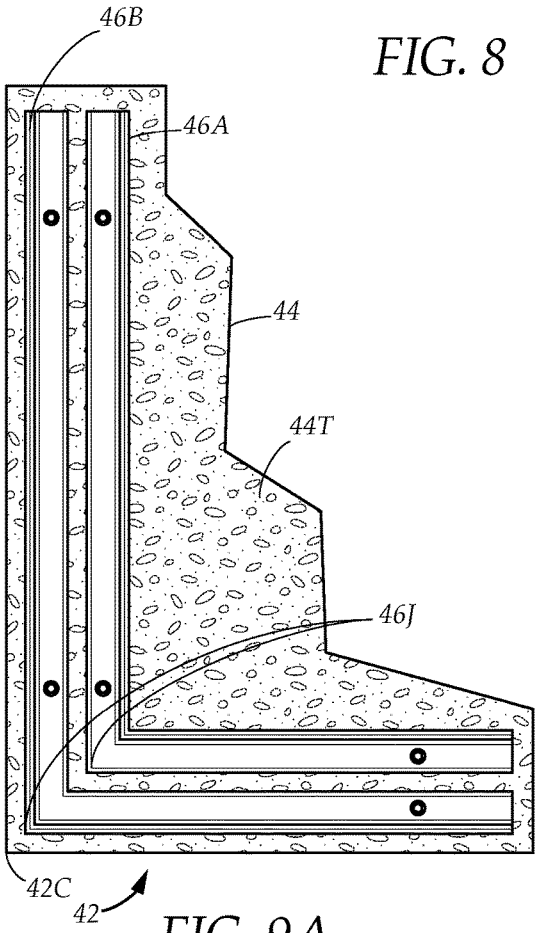
FIG. 9A is a top plan view, showing a pair of panel securing rails secured to a foundation slab.
Figure 9B:
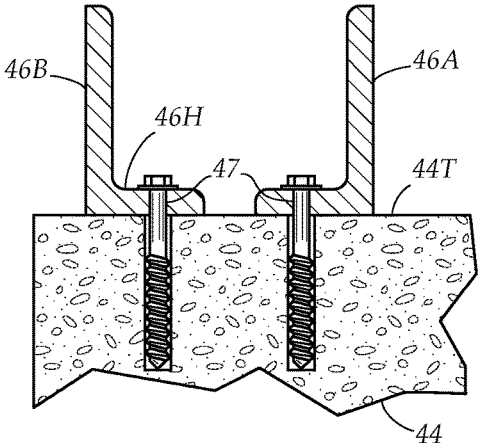
FIG. 9B is a side elevational view with parts broken away, illustrating two panel securing rails anchored within the foundation slab.

FIG. 8, FIG. 9A, and FIG. 9B illustrate the panel securing rails 46, namely the inner rail 46A and the outer rail 46B, and their attachment to the slab 44. In particular the panel securing rail 46 includes a horizontal flange 46H and a vertical flange 46V. The horizontal flange 46H facilitates attachment to the top surface 44T of the slab 44. The horizontal flange 46H may include bores 46E that extend fully therethrough and facilitate the use of bolts 47, or the like, for securing the horizontal flange 46H to the slab 44. The inner rail 46A and outer rail 46B extend substantially parallel or substantially equidistant from each other. Note in FIG. 9A that each of the inner rails and outer rails 46B may be configured with a right angle turn 46J. The right angle turns 46J in the rails 46A, 46B facilitates maintaining wall integrity at corners 42C or the building structure 42 thus created.

Figure 12A:
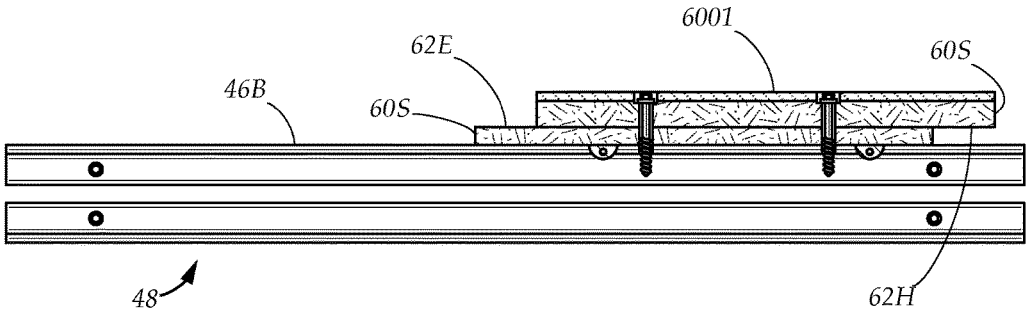
FIG. 12A is a top plan view, illustrating a first exterior panel secured to one of the panel securing rails.
Figure 12B:
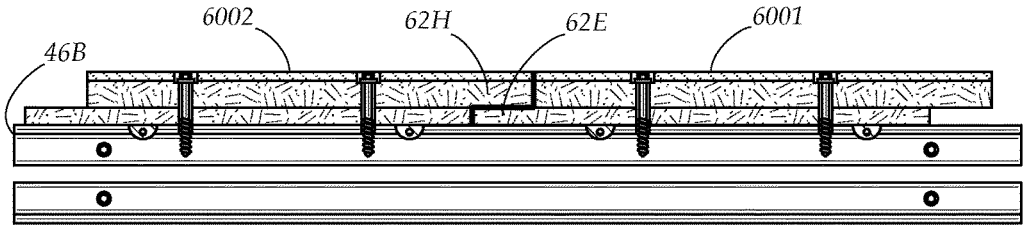
FIG. 12B is a top plan view, illustrating a second exterior panel secured to one of the panel securing rails, adjacent the first exterior panel.
Figure 12C:
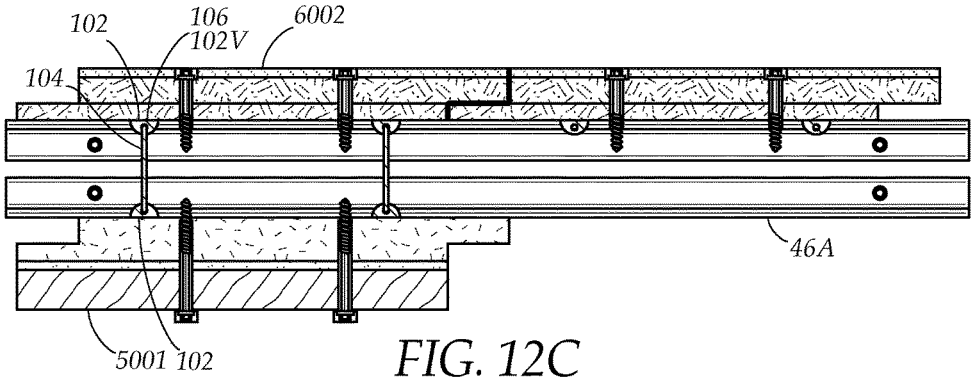
FIG. 12C is a top plan view, illustrating a first interior panel secured to one of the panel securing rails, directly opposed to the exterior panels.
Figure 12D:
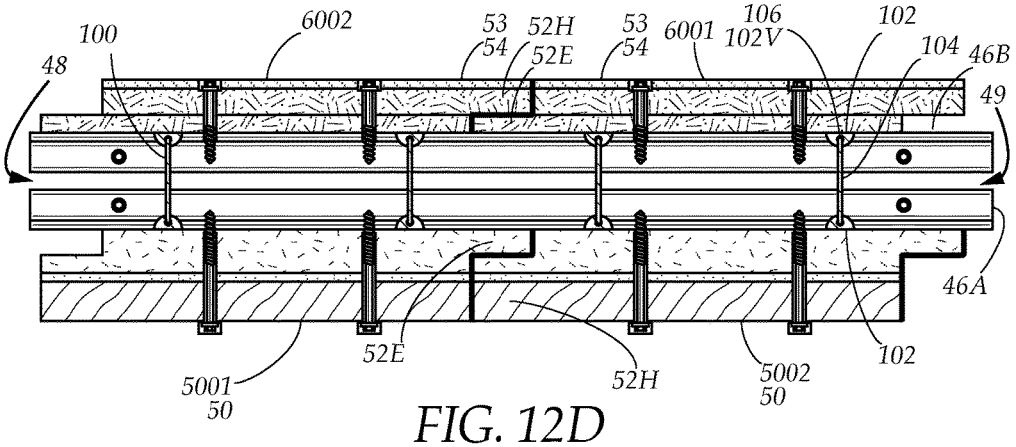
FIG. 12D is a top plan view, illustrating a second interior panel secured to one of the panel securing rails, adjacent to the first exterior panel and opposed to the first and second interior panels, the interior and exterior panels connected together by connecting bars.

Referring now to FIG. 12A through FIG. 12E, construction of a segment of the wall 48 is detailed. In particular, as illustrated in FIGS. 12A and 12B, initially a first exterior panel 6001 is bolted to the outer rail 46B. Then a second exterior panel 6002 is abutted with the first exterior panel 6001 and bolted to the outer rail 46B, with the exposed overlap 62E of the first exterior panel 6001 fitting neatly within the hidden overlap 62H of the second exterior panel 6002. Referring momentarily to FIG. 11, a sealant material 150 may be placed within the overlaps 62H, 62E to create a tight seal therebetween.

In FIG. 12C, with the attachment of a first interior panel 5001 to the inner rail 46A, the connecting brackets 102 of the first interior panel 5001 are aligned with the connecting brackets 102 of the second exterior panel 6002. The connecting brackets may be mated with connecting bars 104 by extending one of the ends 106 of each of the connecting bars 104 into the vertical opening 102V of one of the connecting brackets 102 in the first interior panel 5001 and the other of the ends 106 into the vertical opening 102V into one of the connecting brackets 102 in the second exterior panel 6002.

Figure 12E:
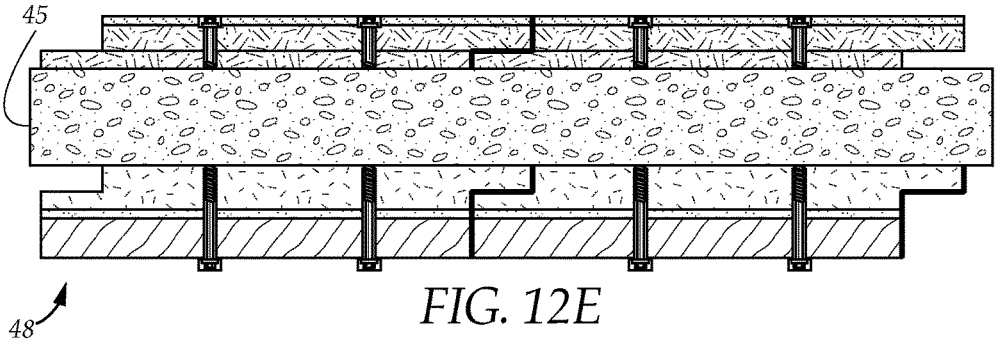
FIG. 12E illustrates a completed wall unit, wherein a vertical interior space between the interior and exterior panels has been filled with concrete.

Then in FIG. 12D, a second interior panel 5002 is abutted with the first interior panel 5001 and bolted to the inner rail 46A, with the exposed overlap 52E of the first interior panel 5001 fitting neatly within the hidden overlap 52H of the second interior panel 5002. With the attachment of the second interior panel 5002 to the inner rail 46A, the connecting brackets 102 of the second interior panel 5002 are aligned with the connecting brackets 102 of the first exterior panel 6001. The connecting brackets may be mated with connecting bars 104 by extending one of the ends 106 of each of the connecting bars 104 into the vertical opening 102V of one of the connecting brackets 102 in the second interior panel 5002 and the other of the ends 106 into the vertical opening 102V into one of the connecting brackets 102 in the first exterior panel 6001. In FIG. 12D, the wall 48 is formed by the interior panels 5001, 5002 secured to the inner rail 46A, the exterior panels 6001, 6002 secured to the outer rail 46B, and the connecting assemblies 100 that hold the panels 5001, 5002, 6001, 6002 together and in a parallel arrangement. The vertical interior space 49 is defined within the wall 48. Referring now to FIG. 12E, the vertical interior space 49 has been filled with concrete 45, such that the wall 48 is now a permanent structure.

Figure 4A:
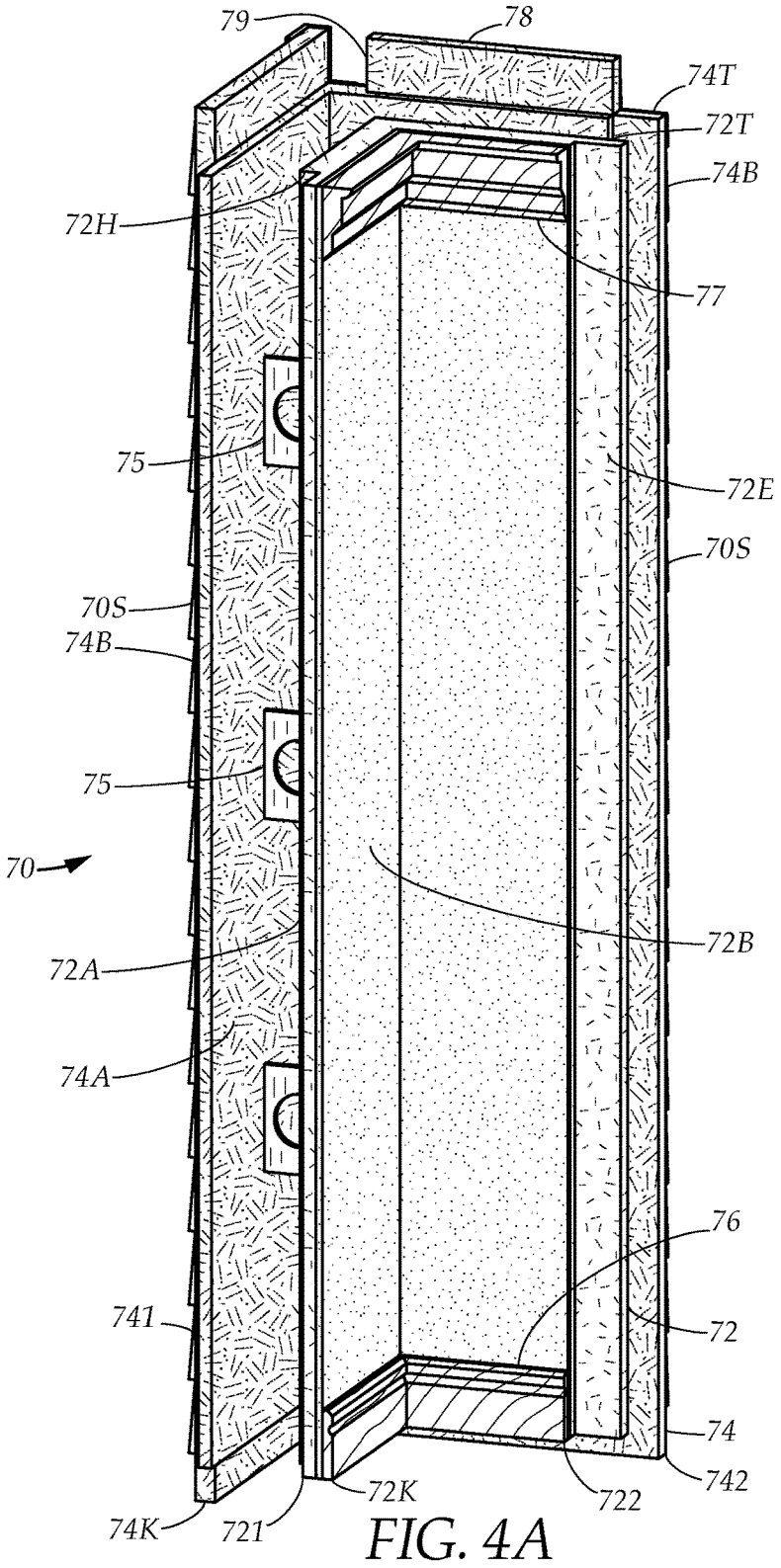
FIG. 4A is a diagrammatic perspective view, showing an inner panel of a corner assembly.
Figure 4B:
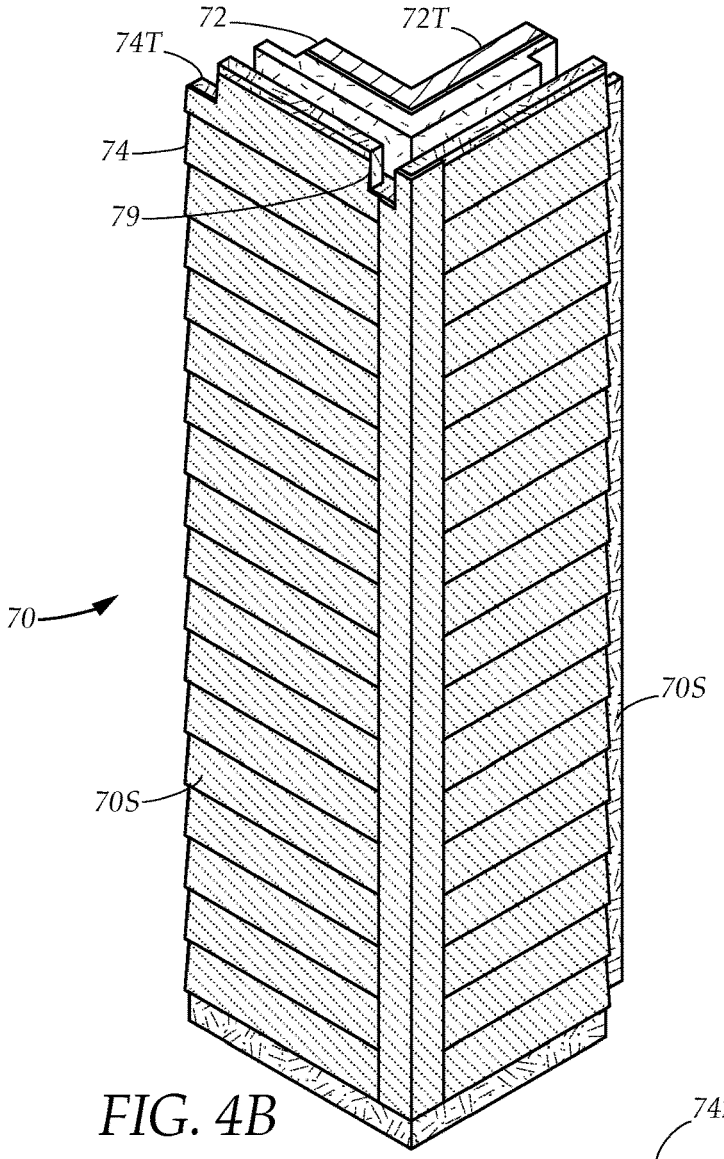
FIG. 4B is a diagrammatic perspective view, showing an outer panel of the corner assembly.
Figure 4C:
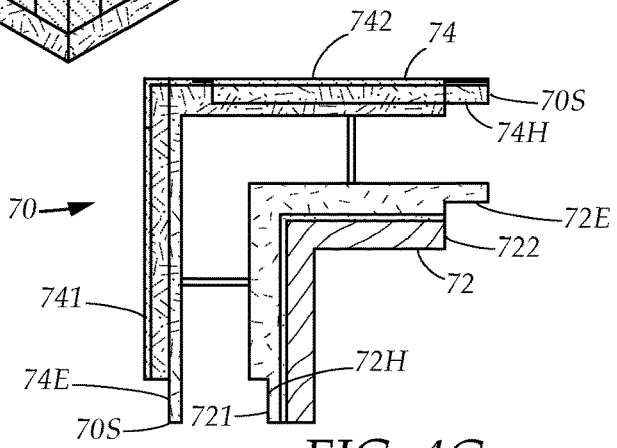
FIG. 4C is a top plan view of the corner assembly.

FIG. 4A, FIG. 4B, and FIG. 4C illustrate one of the corner assemblies 70 having a pair of lateral sides 70S. A typical rectangular structure would have at least four such corner assemblies 70. The corner assemblies 70 each have an inner corner panel 72 and an outer corner panel 74. The corner assemblies 70 are configured so that, when installed, the outer corner panels 74 are aligned with the exterior panels 60, abut, and are adjacent to one of the exterior panels 60 on each of the lateral sides 70S of the corner assembly 70, and the inner corner panels 72 are aligned, abut, and adjacent to one of the interior panels 50 (see FIG. 25B and FIG. 25C) on each of the lateral sides 70S of the corner assembly 70. The inner corner panel 72 and outer corner panel 74 of each corner assembly 70 both make a ninety degree turn and are nested together such that they maintain an equal distance throughout. In particular, the inner corner panel 72 has a first part 721 and a second part 722 that are joined at a right angle; and the outer corner panel 74 has a first part 741 and a second part 742 that are joined at a right angle. Like the interior and exterior panels, the inner corner panel 72 has an interior face 72A and an exterior face 72B, and the outer corner panel 74 has an interior face 74A and an exterior face 74B. The inner and outer corner panels 72, 74 each have a top edge 72T, 74T, and a bottom edge 72K, 74K, respectively. The corner assembly 70 may be prefabricated, such that the inner corner panel 72 and outer corner panel 74 are permanently joined together by several spacer brackets 75 that extend perpendicularly between the interior face 74A of the outer corner panel 74 and the interior face 72A of the inner corner panel 72, and may be positioned high, medium, and low locations as shown or in any suitable positions. Thus, the corner assembly 70 is installed in one piece, with the outer corner panel 74 joined to the outer rail 46B and the inner corner panel 72 joined to the inner rail 46A (see FIG. 25B).

Still referring to FIG. 4A, FIG. 4B, and FIG. 4C, the inner corner panel 72 has a hidden overlap 72H at one of the lateral sides 70S and an exposed overlap 72E at the other of the lateral sides 70S. Similarly, the outer corner panel 74 has a hidden overlap 74H at one of the lateral sides 70S and an exposed overlap 74E at the other of the lateral sides 70S. In addition, the interior face 72A of the inner corner panel 72 has a base molding 76 near the bottom edge 72B and a crown molding 77 near the top edge 72T. Such moldings 76, 77 extend fully between the exposed overlap 72E and the lateral side 70S with the hidden overlap 72H. Note also that the exterior face 74B of the outer corner panel 74 has an upper extension 78 that extends above the top 74B of the outer corner panel 74. The upper extension 78 preferably has notch openings 79 as necessary for accommodating the ceiling joists 80 (see FIG. 25G).

Figure 17:
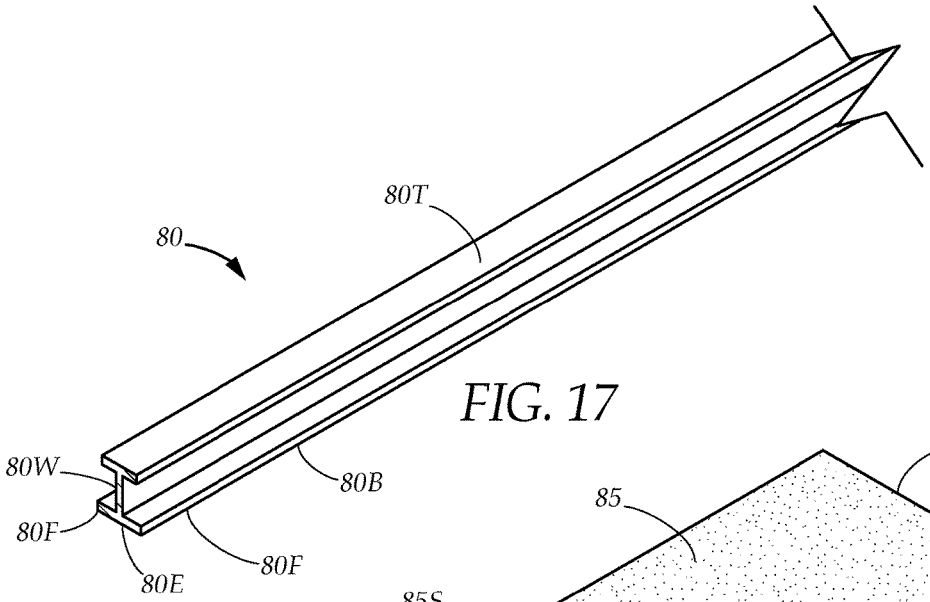
FIG. 17 is a diagrammatic perspective view, illustrating a ceiling joist in accordance with the principles of the present disclosure.
Figure 18:
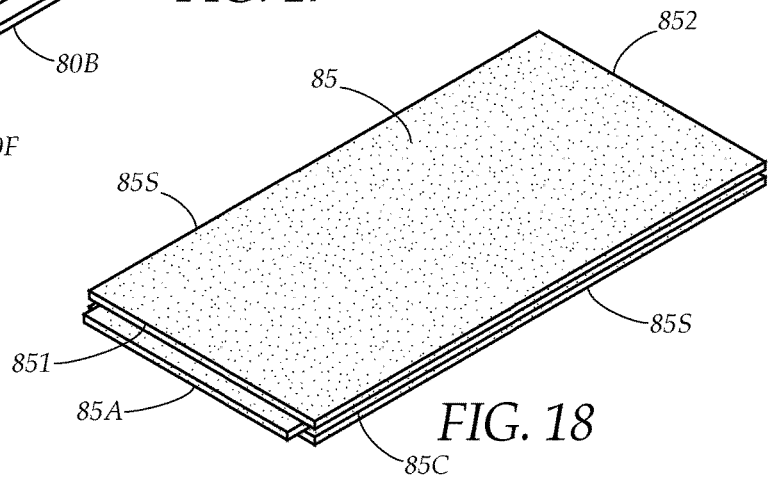
FIG. 18 is a diagrammatic perspective view, illustrating a ceiling panel in accordance with the principles of the present disclosure.
Figure 19:
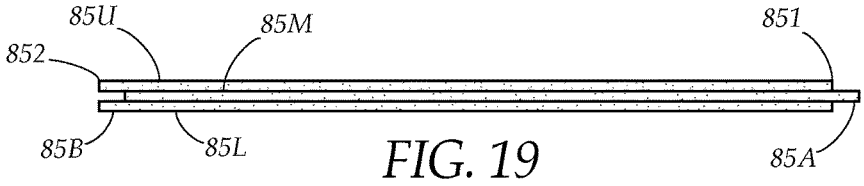
FIG. 19 is a side elevational view of the ceiling panel.
Figure 20:
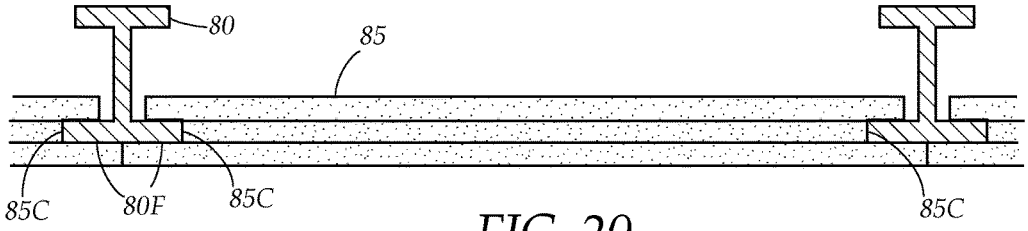
FIG. 20 is a side elevational view with parts broken away, illustrating interconnection of the ceiling panels and ceiling joists.

FIG. 17 illustrates one of the ceiling joists 80. The ceiling joist 80 has a top surface 80T, a bottom surface 80B, and a pair of ends 80E (one of which is not shown). The ceiling joist 80 may be in an I-beam configuration, having a web 80W, and a pair of lower flanges 80F that extend in opposite directions and have the bottom surface 80B. FIG. 18 and FIG. 19 illustrate one of the ceiling tiles 85, having a first end 851, a second end 852, and a pair of lateral sides 85S. Each ceiling tile 85 may include a series of parallel sheets, including an upper sheet 85U, a lower sheet 85L, and a middle sheet 85M. The sheets are offset to provide a tongue 85A at the first end 851 of the ceiling tile 85 and a groove 85B at the second end 852 of the ceiling tile to facilitate joining ceiling tiles end to end. Referring to FIG. 20, the middle sheet 85M is also narrower than the upper sheet 85U and lower sheet 85L to provide a pair of lateral slots 85C that accommodate the lower flanges 80F of one of the ceiling joists 80.

Figure 21:
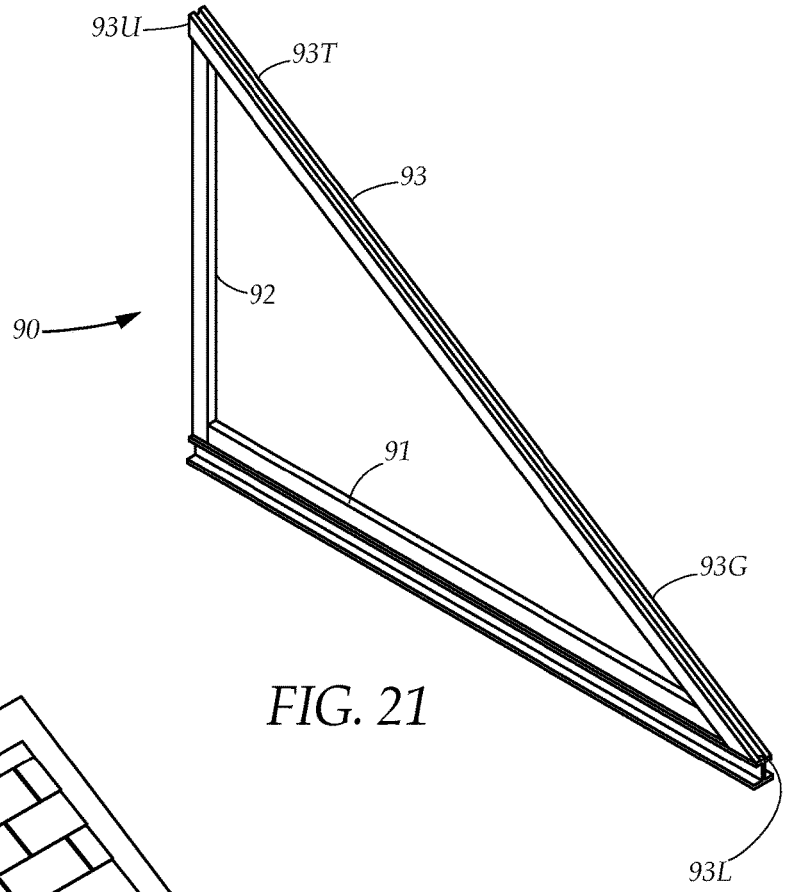
FIG. 21 is a diagrammatic perspective view, illustrating a rafter assembly in accordance with the principles of the present disclosure.
Figure 22:
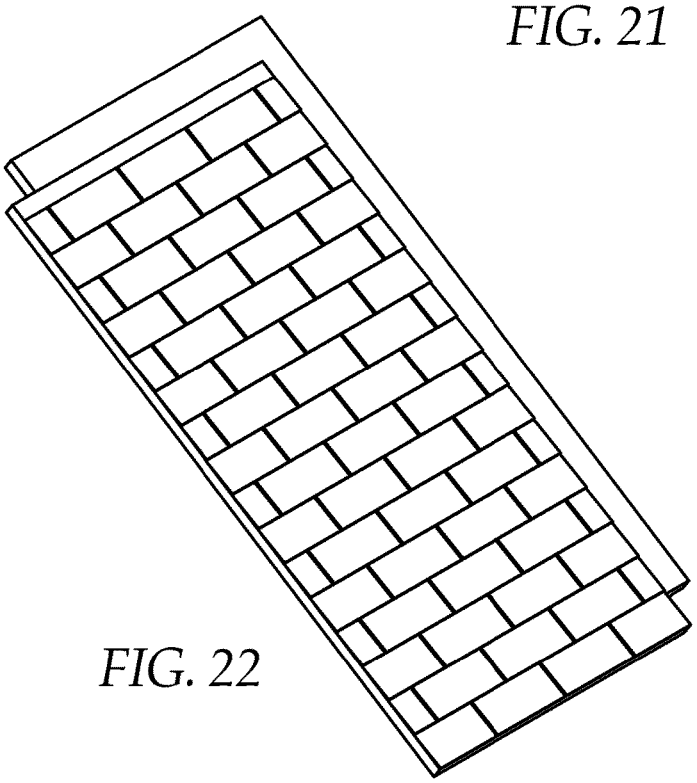
FIG. 22 is a diagrammatic perspective view, illustrating a roofing panel in accordance with the principles of the present disclosure.
Figure 23:
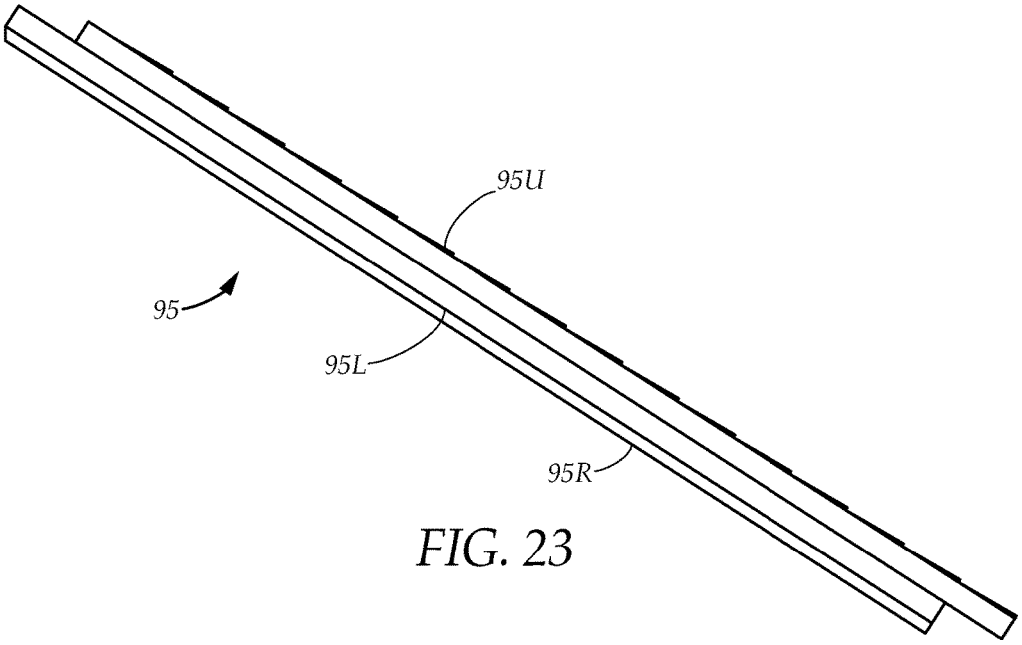
FIG. 23 is a side elevational view of the roofing panel.
Figure 24:
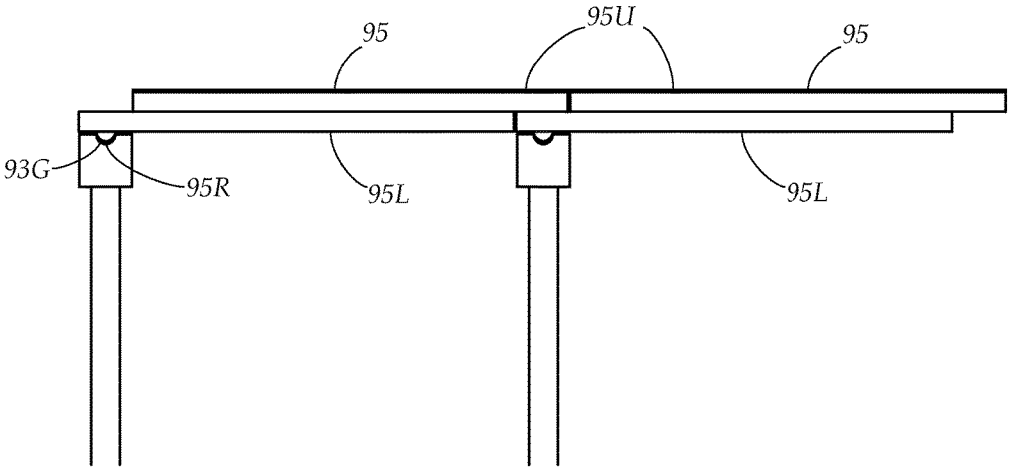
FIG. 24 is a front elevational view, illustrating interconnection of the roofing panel and rafter assemblies.

FIG. 21 shows one of the rafter assemblies 90, having a generally triangular configuration with a horizontal member 91, a vertical member 92, and a sloped member 93. The sloped member 93 has an upper end 93U, a lower end 93L, a top surface 93T, and a groove 93G that extends downwardly into the top surface and extends generally from the upper end 93U to the lower end 93L. FIG. 22 and FIG. 23 show one of the roofing panels 95, having an upper sheet 95U and a lower sheet 95L. The upper and lower sheets 95L may have staggered configurations to facilitate fitting adjacent roofing panels 95 together as shown in FIG. 24. Also seen in FIG. 23 and FIG. 24, the roofing panel 95 has an elongated rib 95R extending downwardly that fits into the groove 93G in the sloped member 93 to help maintain the position of the roofing panels 95 on the rafter assemblies 90.

Referring now to FIG. 25A through FIG. 25G, construction of the building 42 is generally illustrated in stages. Note that only a representative portion of the building structure is shown for the sake of illustration clarity, and that the precise sequence indicated need not be strictly adhered to, as some steps may be reordered where helpful or necessary.

In particular, In FIG. 25A, the inner rails 46A and outer rails 46B are secured to the top surface 44T of the slab 44. Corners are created with the rails 46A, 46B, and linear gaps in the rails 46A, 46B are provided for doors. In FIG. 25B, one of the corner assemblies 70 is mounted to the rails 46A, 46B, and then the exterior panels 60 are fit together, including standard exterior panels 600, window exterior panels 601, and door exterior panels 602. Note that the upper extensions 61U in the exterior panels 60 along one side of the building 42 have notch openings 63, while the upper extensions 61U in the other, perpendicular side of the building 42 do not have notch openings 63.

Then, referring to FIG. 25C, the interior panels 50 have been fit together and positioned in complementary positions, aligned linearly with the exterior panels 60. The interior panels 50 include the standard interior panels 500, the window exterior panels 501, and door interior panels 502. And these interior panels 50 are aligned with the standard exterior panels 600, window exterior panels 601, and door exterior panels 602, respectively. In FIG. 25D, with the door units 130 and window units 120 installed, the interior vertical space 49 in the walls 48 is filled with concrete 45.

With the walls 48 permanently set, in FIG. 25E the ceiling joists 80 are being installed within the notch openings 63 in the outer panels 60 and rest upon the top surfaces 50T, 60T of the interior panels 50 and exterior panels 60. The ceiling joists 80 each span the structure and are supported on an opposite end at an opposing wall (not shown) having interior panels 50 and exterior panels 60 where it is similarly supported upon the top surfaces 50T, 60T thereof. The ceiling tiles 85 are extended between the ceiling joists 80. In FIG. 25F, the rafter assemblies 90 are being positioned on the ceiling joists 80, with the horizontal member 91 appropriately mounted onto the ceiling joists 80. And in FIG. 25G, roofing panels 95 are being installed onto the rafter assemblies 90.

FIG. 26A through FIG. 30D illustrate a further embodiment of the construction system. This further embodiment demonstrates a version of the wall 48 in which the interior panel 50 and exterior panel 60 attach directly to each other and facilitate the creation of concrete columns 45A near the side edges 50S, 60S of the panels 50, 60, while leaving a central portion 49C free of concrete.

Figure 30A:
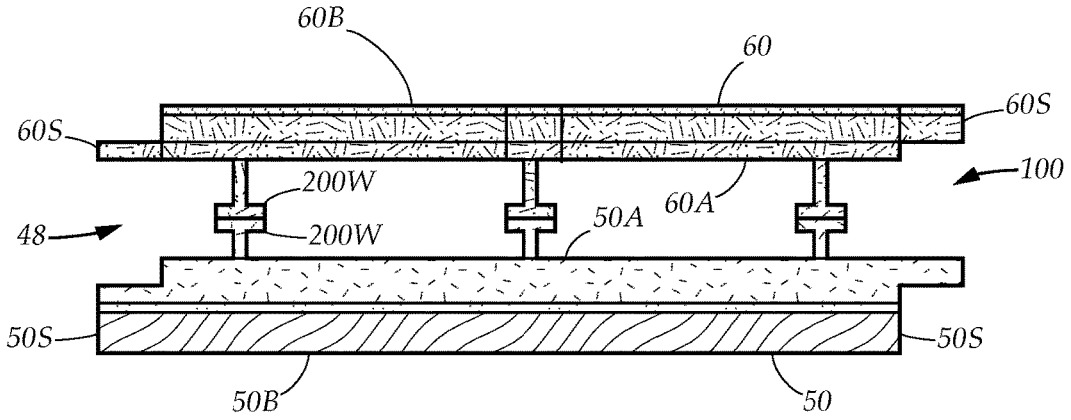
FIG. 30A is a top plan view, illustrating the interior panel and exterior panel mated together.
Figure 30B:
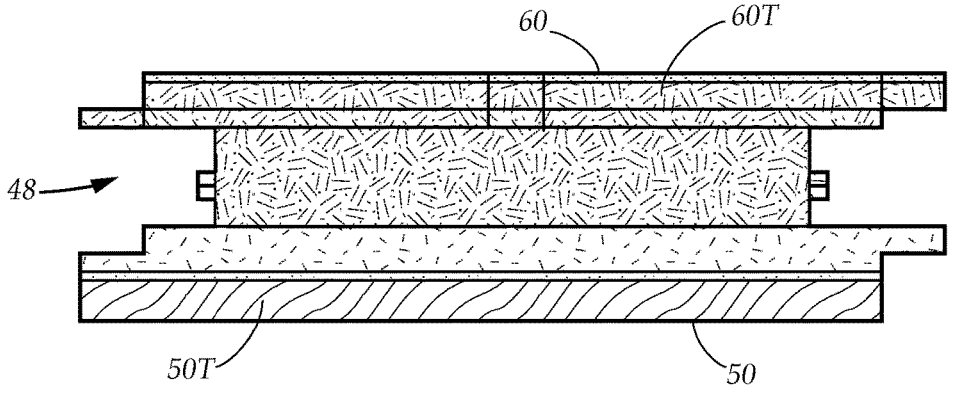
FIG. 30B is a top plan view similar to FIG. 30A, except wherein a central portion between the interior panel and exterior panel is covered by the mask panel.
Figure 30C:
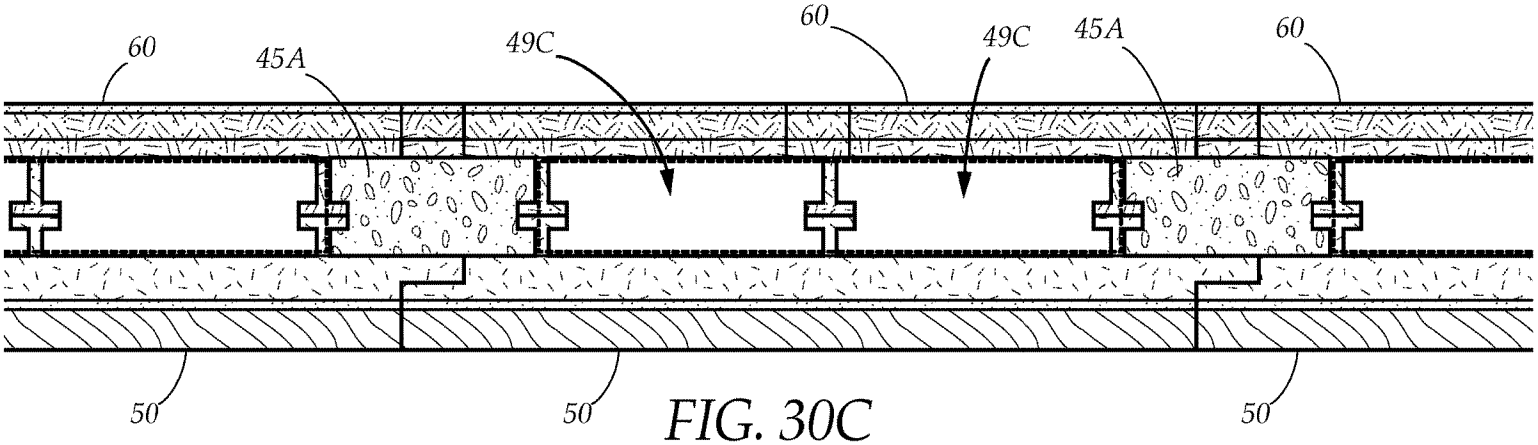
FIG. 30C is a top plan view, with parts broken away, illustrating how vertical columns of concrete are created near the side edges of the panels, while a central portion has not been filled.

To facilitate attachment of the interior panel 50 and exterior panel 60, a further embodiment of the connector assembly 100 includes a pair of vertically extending outer beams 200 and a vertically extending connector beam 202 attached on the interior faces 50A, 60A of each of the interior panel 50 and exterior panel 60. The outer beams 200 extend somewhat near the lateral sides 50S, 60S of the panels 50, 60. The connector beams 202 extend centrally between the outer beams 200 and substantially parallel thereto. In particular, the connector beams 202 include a male connector beam 202M and a female connector beam 202F. As illustrated, the interior panel 50 has the male connector beam 202M and the exterior panel 60 has the female connector beam 202F. All of the beams 200, 202, include a web 200W, 202W, and a flange 200G, 202G. Best seen in FIGS. 28A and 28B, the male connector beam 202M has a pair of offset tabs 206, including an upper offset tab 206U and a lower offset tab 206L. The female connector beam has a lower opening 206E and an upper catch 206C. The lower opening 206E is sized to allow the lower offset tab 206L to extend laterally therein and then hook onto the female connector beam 202F. The upper catch 206C is a shortening of the web 202W of the female connector beam 202F such that the flange 202G thereof extends slightly higher to allow the upper offset tab 206U to hook thereonto. As seen in FIG. 30A, when the male connector beam 202M and female connector beam 202F are connected, the webs 200W, 202W of the connector beams 202M, 202F and the outer beams 200 abut each other.

Figure 26A:
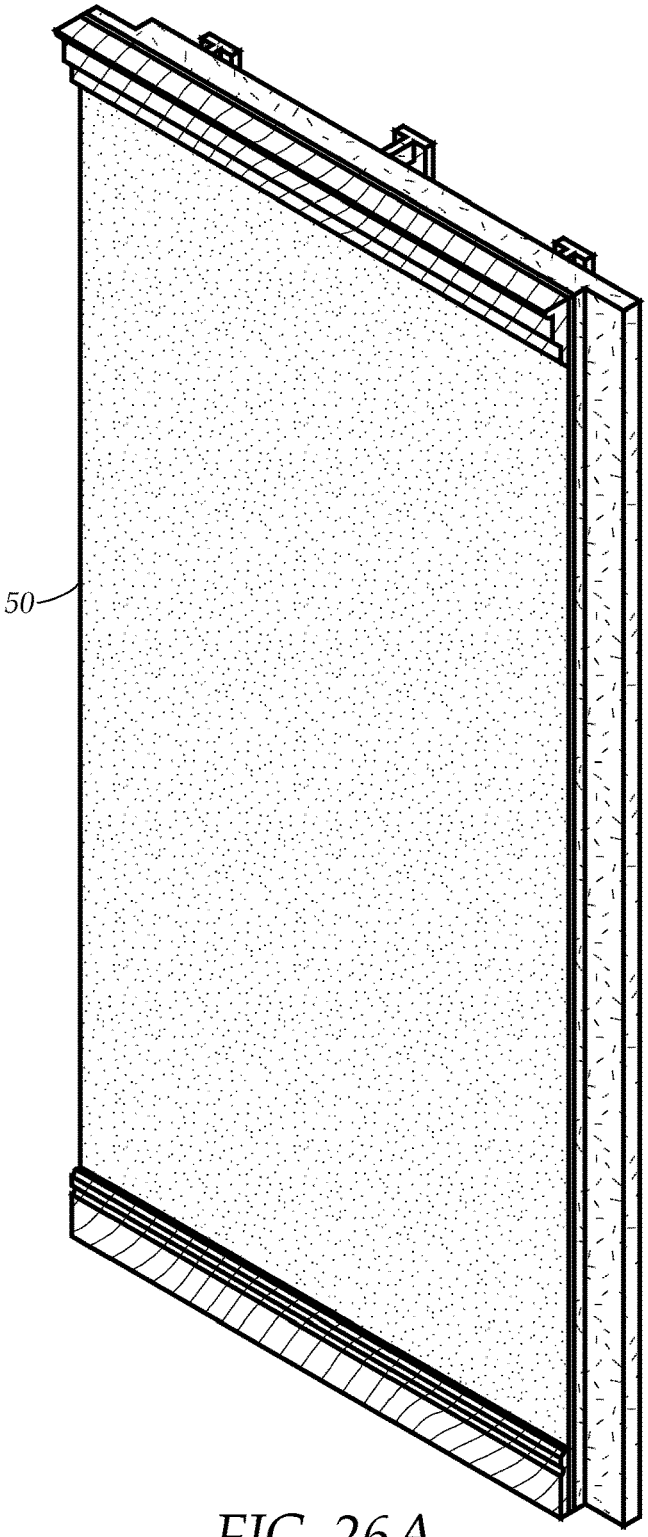
FIG. 26A is a diagrammatic perspective view, illustrating an exterior face of an interior panel in accordance with a further embodiment of the construction system described herein.
Figure 26B:
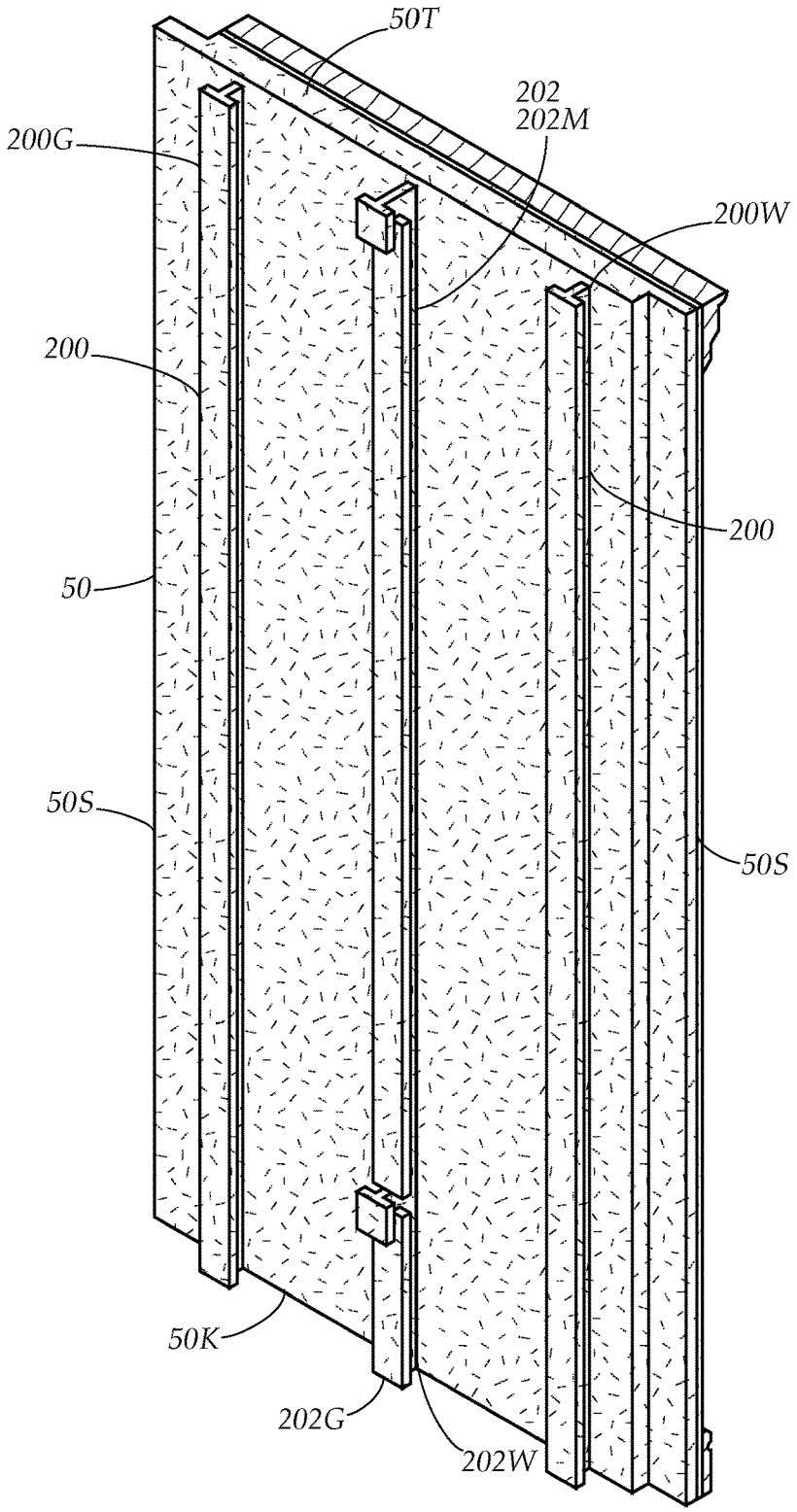
FIG. 26B is a diagrammatic perspective view, illustrating an interior face of the interior panel in accordance with the further embodiment of the construction system described herein.
Figure 27A:
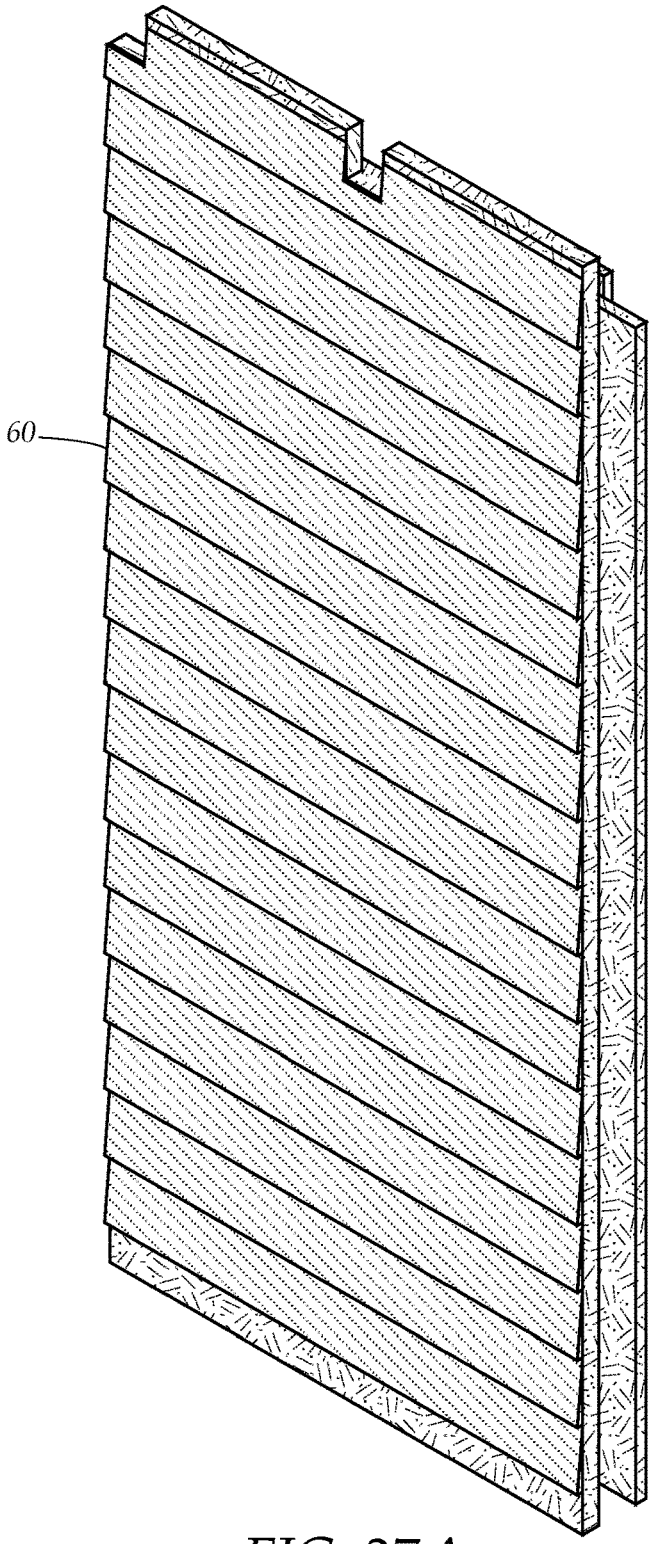
FIG. 27A is a diagrammatic perspective view, illustrating an exterior face of an exterior panel in accordance with a further embodiment of the construction system described herein.
Figure 27B:
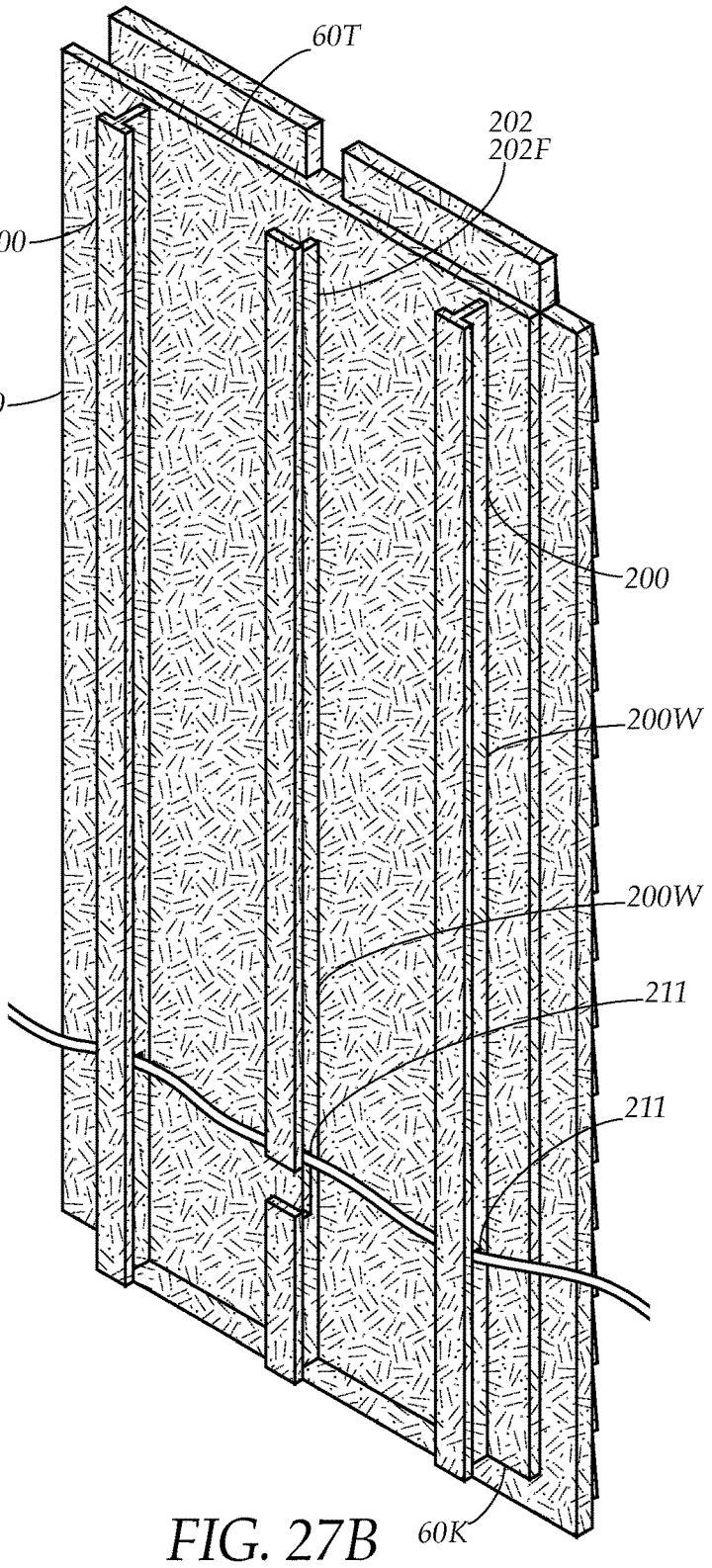
FIG. 27B is a diagrammatic perspective view, illustrating an interior face of the exterior panel in accordance with the further embodiment of the construction system described herein.
Figure 28A:
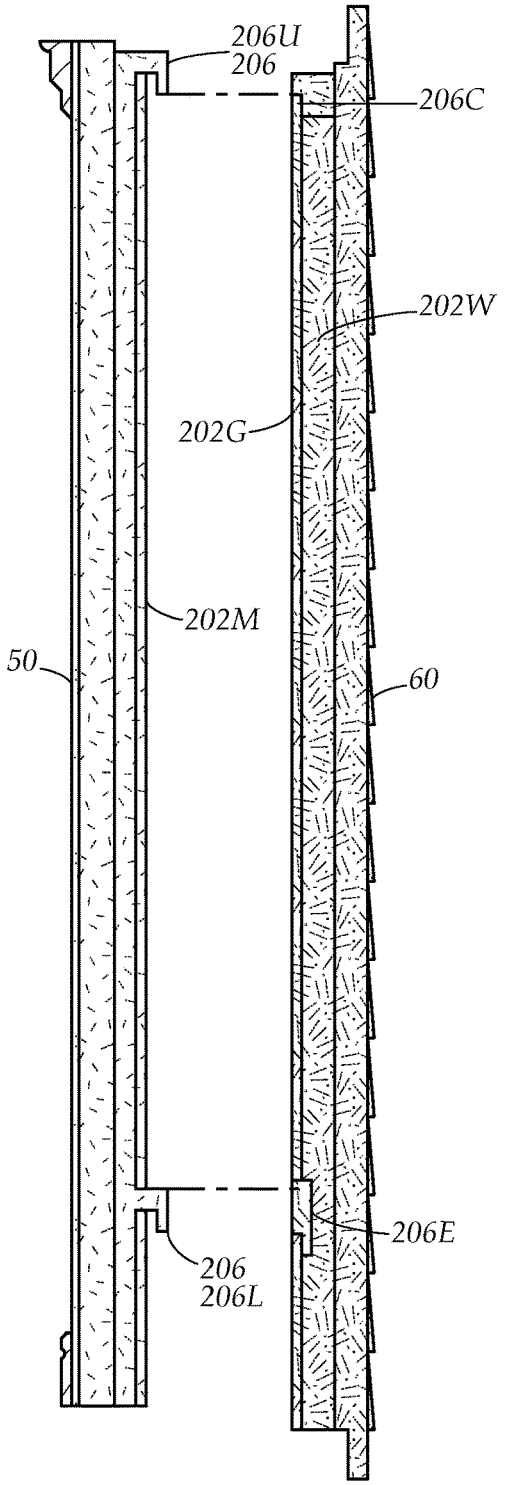
FIG. 28A is a side elevational view with parts broken away, illustrating the interior panel in accordance with the further embodiment about to be mated with the exterior panel in accordance with the further embodiment of the construction system.
Figure 28B:
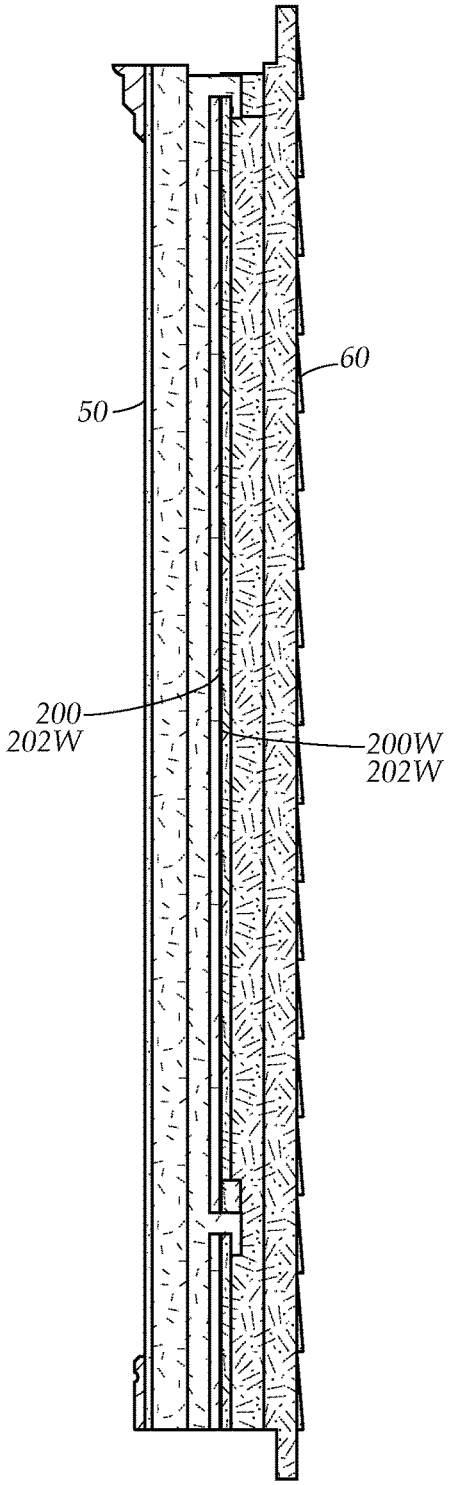
FIG. 28B is a side elevational view with parts broken away, illustrating the interior panel in accordance with the further embodiment mated with the exterior panel in accordance with the further embodiment of the construction system.
Figure 29A:
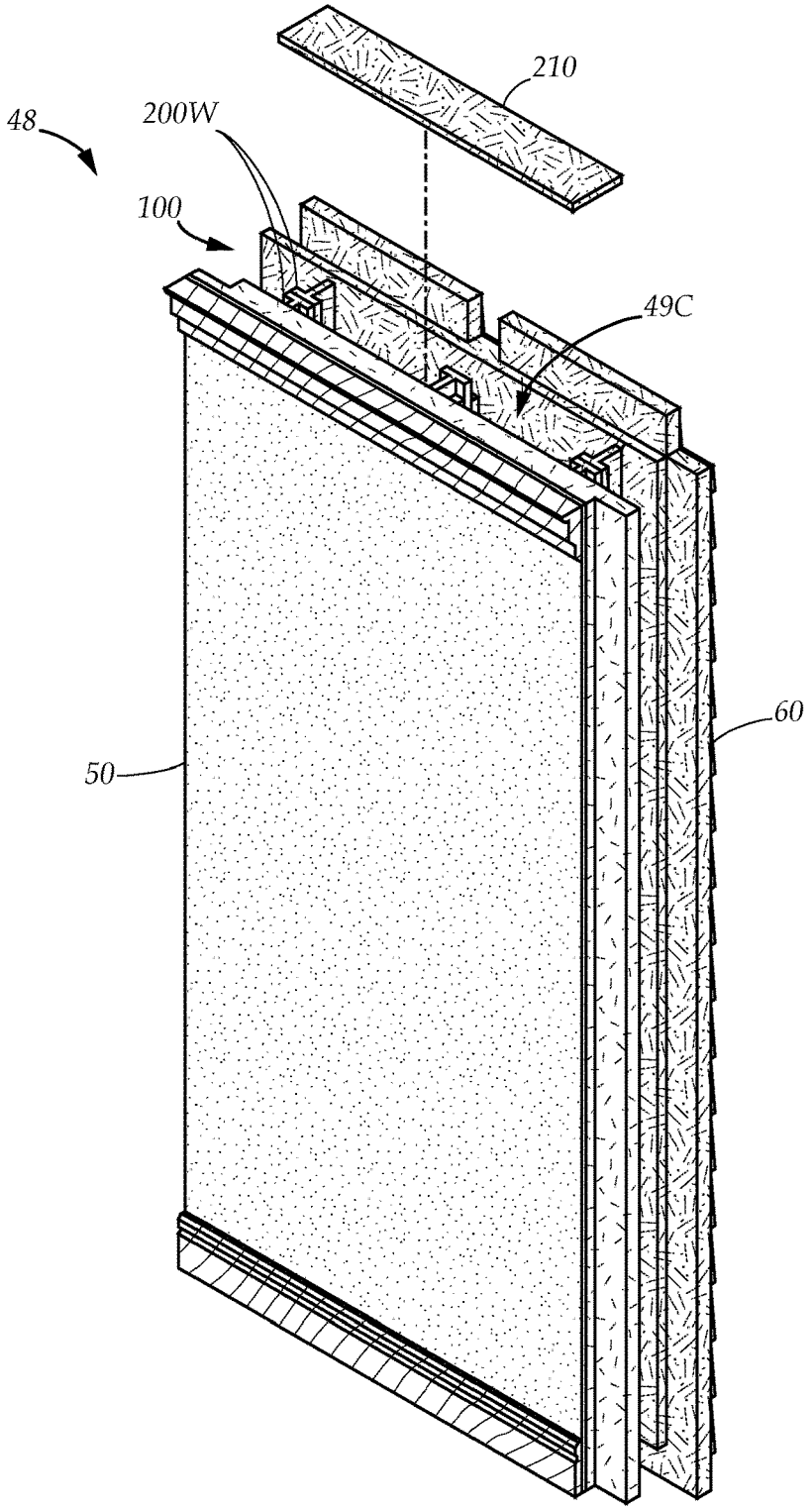
FIG. 29A is a diagrammatic perspective view, illustrating a wall unit, including the interior panel and the exterior panel, wherein a mask panel is being positioned centrally between side edges of the panels.
Figure 29B:
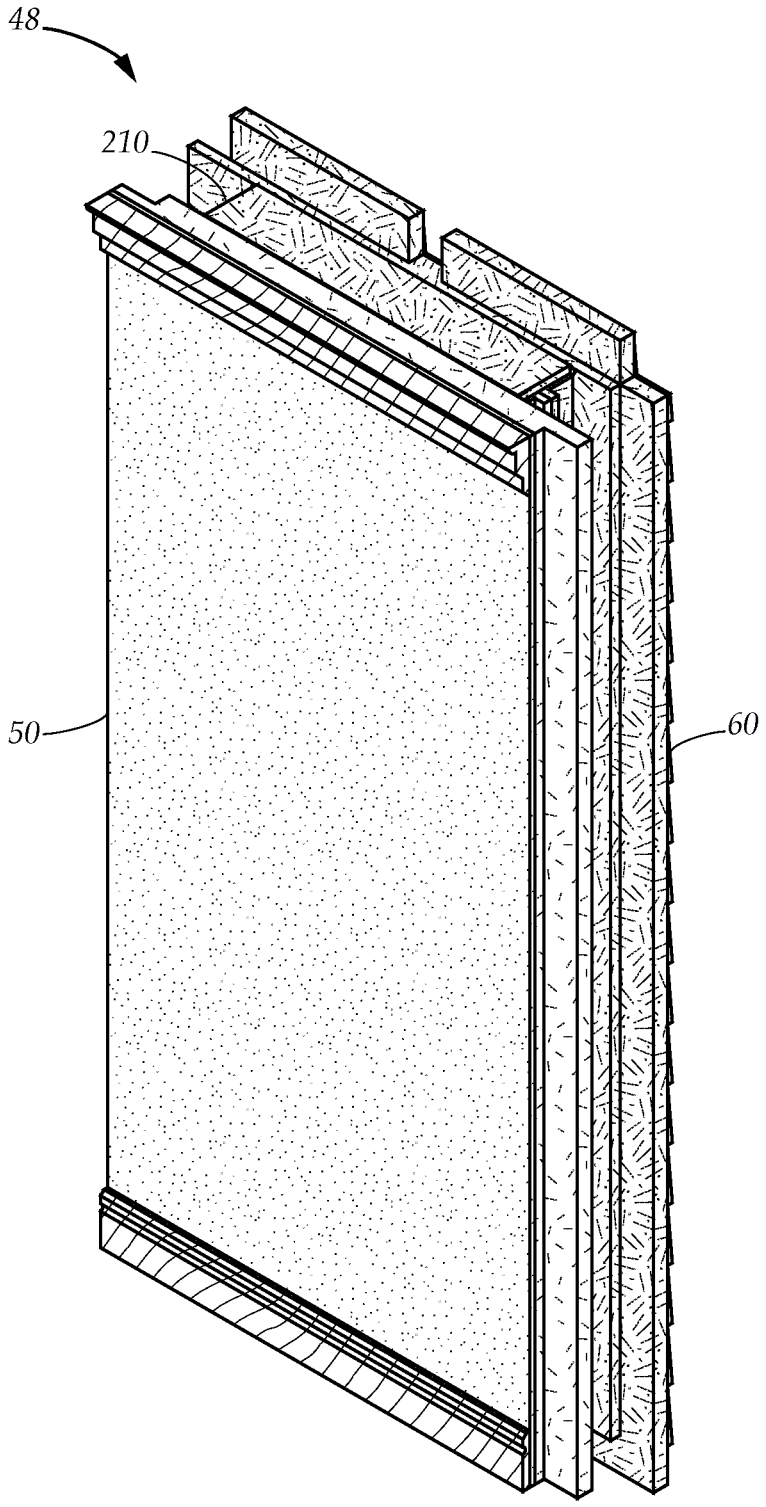
FIG. 29B is a diagrammatic perspective view, illustrating the wall unit, wherein the mask panel is positioned centrally between side edges of the panels.
Figure 30D:
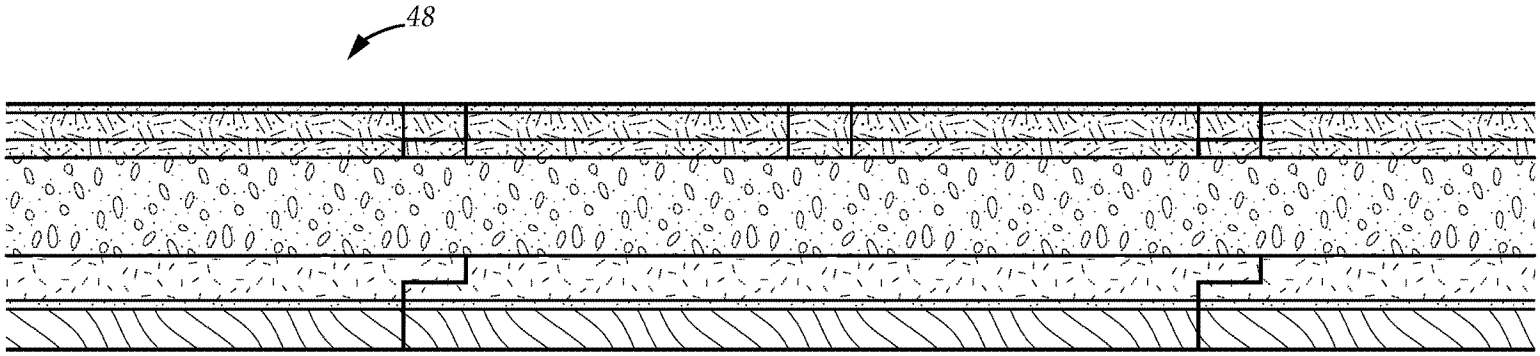
FIG. 30D is a top plan view, illustrating another embodiment, wherein contiguous concrete fills the spaces between the panels.

Referring to FIG. 26B and FIG. 27B, the outer beams 200 and connector beam 202 extend fully to the bottom edge 50K, 60K of the interior panel 50 and exterior panel 60. Provision may be given in some embodiments to allow the outer rail and inner rail to extend upwardly alongside the interior faces 50A, 60A of the panels 50, 60 so that the further embodiment is compatible with the system described hereinabove. Lateral openings 211 may be provided in the webs 202W, 200W beams 200, 202 to facilitate creating a chase way for wiring and plumbing. Note that the outer beams 200 and connector beams 202 do not, however, extend fully to the top edge 50T, 60T. In particular, a small space is provided to allow a mask panel 210 to extend between the interior panel 50 and exterior panel 60 and laterally extend between the outer beams 200 as seen in FIG. 29A and FIG. 29B. With the mask panel 210 in place, concrete may be poured outwardly of the mask panel 210, creating concrete columns 45A between adjacent panels 50, 60 that make up the wall 48, and leaving a central portion 49C within the wall 48 free of concrete. Alternatively, concrete may be poured above the mask panel 210 as well, creating a concrete bridge near the top edge 50T, 60T that spans between the concrete columns 45A as shown in FIG. 30D. It is important to note, however, that numerous variations are possible for changing the manner and configuration of the structural fill, while adhering to the principles described herein for creating pre-fabricated buildings using the components described herein.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a pre-fabricated building construction system that increases construction speed and reduces construction costs by using pre-fabricated components. The disclosure is illustrated by example in the drawing figures, and throughout the written description. It should be understood that numerous variations are possible, while adhering to the inventive concept. Such variations are contemplated as being a part of the present disclosure.

What is claimed is:

1. A building construction method, for creating a building structure on a foundation slab having a top surface and side surface, using a plurality of exterior panels each having lateral sides, a top edge, a bottom edge, an interior face and an exterior face having an exterior finish material, also using a plurality of interior panels each having lateral sides, a top edge, a bottom edge, an interior face and an exterior face having an interior finish material and a base molding substantially extending between the lateral sides near the bottom edge and a crown molding substantially extending between the lateral sides near the top edge, also using an inner rail and an outer rail, also using ceiling joists, ceiling tiles, roofing panels each having an elongated rib, and using rafter assemblies each having a horizontal member, a vertical member, and a sloped member having a top surface, an upper end, and a lower end, the sloped member has a groove that extends downwardly into the top surface from the upper end to the lower end, comprising the steps of:

securing the inner rail and outer rail to the top surface of the foundation slab, the inner rail extending parallel to the outer rail;

securing at least two of the exterior panels to the outer rail, including a first exterior panel and a second exterior panel, one of the lateral sides of the first exterior panel abutting the second exterior panel;

defining a wall with an interior vertical space between the at last two exterior panels and at least two of the interior panels, including a first interior panel and a second interior panel, by securing said at two interior panels to the inner rail with one of the lateral sides of the first exterior panel abutting one of the lateral sides of the second exterior panel, the base molding of the first exterior panel abutting the base molding of the second exterior panel and the crown molding of the first exterior panel abutting the crown molding of the second exterior panel, with the first interior panel substantially parallel and across from the second exterior panel and the second interior panel substantially parallel to and across from the first exterior panel;

filling the interior vertical space by pouring concrete into the interior vertical space;

installing ceiling joists supported by the top edges of exterior panels and interior panels;

installing rafter assemblies supported by the ceiling joists;

installing ceiling panels between the ceiling joists; and installing roofing panels supported by the rafter assemblies by extending the elongated rib of each of of the roofing panels into the groove of the sloped member of one of the rafter assemblies.

2. The building construction method as recited in claim 1, using a connecting assembly, and wherein the step of defining a wall with an interior vertical space between the at least two exterior panels and the at least two interior panels further comprises attaching the interior and exterior panels together using the connecting assembly, wherein the connecting assembly includes a pair of connecting brackets each having a horizontal flange with a vertical opening, the connecting assembly further having a connecting rod having a main part and a pair of ends extending perpendicularly from the main part, one of the connecting brackets attached to the interior face of one of the second interior panels and the other of the connecting brackets attached to the interior face of the first exterior panel; and wherein the step of connecting the second interior panel to the first exterior panel further comprises inserting the ends of the connecting rod into the vertical openings of the connecting brackets.

3. The building construction method as recited in claim 2, wherein the interior panels each have a hidden overlap at one of the lateral edges and an exposed overlap at the other of the lateral edges, the base molding of each interior panel extending across the exterior face near the bottom edge between the lateral side having the hidden overlap and the exposed overlap; and wherein the step of installing the second interior panel adjacent to the first interior panel further comprises abutting the base molding of the first interior panel against the base molding of the second interior panel where the hidden overlap of one of said interior panels meets the exposed overlap of the other of said interior panels.

4. The building construction method as recited in claim 3, wherein the inner rails and outer rails each make at least one right turn and remain parallel to each other and further using at least one corner assembly having a pair of lateral sides, and an inner corner panel and an outer corner panel that are permanently joined together by spacer brackets, the inner corner panel has a first part and a second part that are joined at a right angle, the outer corner panel having a first part and a second part that are joined at a right angle, the inner corner panel and outer corner panel are parallel to each other; and wherein the step of defining a wall with an interior vertical space further comprises securing the corner assembly to the inner rail and outer rail with the outer rail secured to the outer corner panel and the inner rail secured to the inner corner panel with the inner corner panel adjacent to and abutting one of the interior panels on one of the lateral sides of the corner assembly and the outer corner panel adjacent to and abutting one of the exterior panels on one of the lateral sides of the corner assembly.

5. The building construction method as recited in claim 4, wherein the inner corner panel has a hidden overlap on one of its lateral sides and an exposed overlap on the other of its lateral sides, the inner corner panel further having an interior face having a bottom edge and has a base molding extending on the interior face along the bottom edge between the lateral side having the hidden overlap and the exposed overlap; and wherein the step of abutting one of the interior panels on one of the lateral sides of the corner assembly further comprises abutting the base molding of the corner assembly with the base molding of said interior panel.

6. The building construction method as recited in claim 5, wherein the exterior panels having a top edge and a bottom edge, the exterior face of each of the exterior panels have an upper extension that extends above the top edge of the exterior panels and a bottom edge that extends below the bottom edge of the exterior panel, and wherein the step of securing at least one of the exterior panels to the outer rail further comprises extending the bottom edge of said exterior panel against the top surface of the foundation slab and the lower extension of said exterior panel downwardly alongside the side surface of the foundation slab.

7. The building construction method as recited in claim 6, wherein the plurality of interior panels include standard panels having a substantially continuous exterior face and window interior panels having a window cutout in the interior face and exterior face; wherein the exterior panels include standard panels having a substantially continuous exterior face and window exterior panels having a window cutout in the interior face and exterior face; and wherein the step of defining a wall with an interior vertical space between the exterior panel and one of the interior panels further comprises installing a window frame in the wall by extending the window frame through the window cutout in the exterior face of said window interior panel, past the interior face of said window interior panel and through the window cutout in said window exterior panel.

8. The building construction method as recited in claim 7, wherein the plurality of interior panels include door interior panels having a door cutout in the interior face and exterior face; wherein the exterior panels include door exterior panels having a door cutout in the interior face and exterior face; and wherein the step of installing at least one exterior panel further comprises installing a door frame in the wall by extending the door frame through the door cutout in the exterior face of said door interior panel, past the interior face of said door interior panel and through the door cutout in said door exterior panel.

* * * * *